US007770655B2

(12) United States Patent
Wilde et al.

(10) Patent No.: US 7,770,655 B2
(45) Date of Patent: Aug. 10, 2010

(54) CONDUCTOR CASING INSTALLATION BY ANCHOR HANDLING/TUG/SUPPLY VESSEL

(75) Inventors: Gordon Robert Wilde, Houston, TX (US); Pieter Van Luipen, Ellerau (DE); Eckhard Zamboni, Ellerau (DE)

(73) Assignee: InterMoor Inc., Houston, TX (US)

( * ) Notice: Subject to any disclaimer, the term of this patent is extended or adjusted under 35 U.S.C. 154(b) by 59 days.

(21) Appl. No.: 11/458,411

(22) Filed: Jul. 19, 2006

(65) Prior Publication Data

US 2007/0017680 A1 Jan. 25, 2007

Related U.S. Application Data

(60) Provisional application No. 60/700,879, filed on Jul. 20, 2005.

(51) Int. Cl.
*E02D 9/00* (2006.01)
*E21B 7/12* (2006.01)

(52) U.S. Cl. ..... 166/381; 166/352; 166/358; 405/228; 175/5; 175/257

(58) Field of Classification Search ..... 166/356, 166/367, 244.1, 352, 366, 381, 358; 405/228, 405/224, 224.1, 226; 175/171, 257, 5
See application file for complete search history.

(56) References Cited

U.S. PATENT DOCUMENTS 3,680,644 A * 8/1972 Doughty ..... 173/212
3,817,040 A * 6/1974 Stevens ..... 405/228
3,820,346 A * 6/1974 Wisotsky ..... 405/228
4,045,969 A * 9/1977 Jansz ..... 405/228
4,055,224 A * 10/1977 Wallers ..... 175/5
4,063,599 A * 12/1977 Jansz ..... 173/1
4,257,721 A * 3/1981 Haynes ..... 405/227
4,277,051 A * 7/1981 Lucas ..... 254/106
4,432,671 A * 2/1984 Westra et al. ..... 405/226
4,572,304 A * 2/1986 Mahar et al. ..... 175/5
4,739,840 A * 4/1988 Cox ..... 175/9
4,740,107 A * 4/1988 Casbarian et al. ..... 405/211
4,830,541 A * 5/1989 Shatto ..... 405/226
5,012,875 A * 5/1991 Casbarian et al. ..... 175/9
5,090,485 A * 2/1992 Pomonik et al. ..... 173/1
5,122,010 A * 6/1992 Burguieres et al. ..... 405/204
5,498,107 A * 3/1996 Schatzle, Jr. ..... 405/224
5,549,164 A * 8/1996 Blandford ..... 166/344
6,102,119 A * 8/2000 Raines ..... 166/244.1
6,113,315 A * 9/2000 Fulton et al. ..... 405/224.1

(Continued)

OTHER PUBLICATIONS

Brochure entitled "PreConduct" Preinstallation of conductors, Main Contractor NeoDrill AS, Piling IHC Hydrohammer, Vessel Solstad Offshore ASA, 4 pages.

(Continued)

*Primary Examiner*—Thomas A Beach

(57) ABSTRACT

An anchor handling/tug/supply (AHTS) vessel is employed to engage conductor casings with the seafloor. The conductor casings initially penetrate the seafloor to a first depth under their own weight. The conductor casings may optimally be further engaged with the seafloor to a second depth by the application of suction to the interiors thereof or by the use of a drop hammer. The conductor casings are driven to grade by a hydraulic pile driving hammer deployed from the deck of the AHTS vessel the previously deployed conductor casings to grade before being recovered to the deck of the AHTS vessel.

2 Claims, 27 Drawing Sheets

U.S. PATENT DOCUMENTS 6,318,471 B1 * 11/2001 Raines ..... 166/381
6,659,182 B1 * 12/2003 Saugier et al. ..... 166/358
6,692,194 B2 2/2004 Strand
6,719,496 B1 * 4/2004 Von Eberstein ..... 405/224
6,783,305 B2 * 8/2004 Hall et al. ..... 405/227
7,513,310 B2 * 4/2009 Fossli ..... 166/358
7,527,455 B2 * 5/2009 Raines ..... 405/228

OTHER PUBLICATIONS

Subsea UK 161204 rev. 2.ppt, Paul Alcock, Acteon, Dec. 16, 2004.

* cited by examiner

CONDUCTOR CASING INSTALLATION BY ANCHOR HANDLING/TUG/SUPPLY VESSEL

CLAIM OF PRIORITY

This application claims priority of provisional application Ser. No. 60/700,879 filed Jul. 20, 2005, currently pending, the entire contents of which are incorporated herein by reference.

TECHNICAL FIELD

This invention relates generally to installation of petroleum and gas well casings, and more specifically to the installation of the outermost casing, commonly referred to as the conductor casing, without the use of Construction Vessels. In lieu of a Construction Vessel the conductor casing is installed to grade in the seafloor by means of a hydraulic pile driving hammer deployed from the deck of an Anchor Handling/Tug/Supply (AHTS) vessel.

BACKGROUND AND SUMMARY OF THE INVENTION

Traditionally, the outermost well casing (commonly referred to as the conductor casing) in petroleum and gas wells is installed by a Mobile Offshore Drilling Unit (MODU) or drilling rig that will also complete drilling the well to final depth. The conductor casing, generally 30" to 36" diameter pipe, 200 ft to 600 ft in length, is the first well casing installed. There are a number of methods utilized for installing the conductor casing to final penetration depth including jetting, turbo-drilling, and hammering.

In the jetting process the conductor casing is lowered on the MODU's drill string. At the tip of the conductor casing a jetting fixture on the end of the drill string allows the vessel to pump water or other fluids down the drill string and through the jetting fixture in an action that washes away the soil underneath the tip of the conductor casing allowing it to penetrate the soil.

Turbo-drilling is a variation of jetting in that a so called mud motor is affixed to the end of the drill string at the tip of the conductor casing. When fluids are pumped down the drill string the mud motor rotates causing a large drill bit to rotate at the tip of the conductor casing. The drill bit removes soil allowing the conductor casing to penetrate the soil.

Hammering refers to use of a pile hammer deployed from the MODU to drive the conductor casing into the soil. Because there is much less disturbance of the soil by hammering the conductor casing it is less likely to experience subsidence problems and is considered by many in the industry to be the preferred method if cost, hammer handling and rigging issues are excluded.

Regardless of the method used to install the conductor casing by the MODU it generally accepted by the offshore oil industry that substantial cost savings can be realized by pre-installing the conductor casings prior to the arrival of the MODU. This allows the MODU to proceed at once with conventional drilling and casing activities once it arrives at the wellsite.

Conductor casing pre-installation has been preformed previously but only by the use of so called Construction Vessels. Examples of Construction Vessels include Semi-submersible Crane Vessels (SSCV), Multi-service Vessels (MSV), Diving Support Vessels (DSV), Derrick Barges and Pipe Lay Barges.

In accordance with the present invention a hydraulic pile driving hammer is deployed from the work deck of a non-construction vessel, specifically an Anchor Handling/Tug/Supply (AHTS) vessel. The procedures, devices and equipment needed to perform this action provide an economic advantage due to the fact that the AHTS vessel lease rates are traditionally much less than MODU and Construction Vessel lease rates. By way of example, typical day rates for the foregoing vessels are as follows:

| | |
|---|---|
| SSCV: | $250,000 to $500,000 per day |
| MSV: | $150,000 per day |
| DSV: | $100,000 to $250,000 per day |
| Derrick/Pipe Lay Barge: | $250,000 to $500,000 per day |
| AHTS: | $75,000 to $95,000 per day |

A perceived advantage to both the AHTS and Construction Vessel approach is that the conductor casings are "batch set", meaning many or all the conductor casings needed in a particular oil or gas field are installed in short duration of time. This allows the soil surrounding the conductor casing to reconsolidate or "setup", thereby providing higher vertical load capacity and lessening the likelihood of subsidence.

BRIEF DESCRIPTION OF THE DRAWINGS

A more complete understanding of the present invention may be had by reference to the following Detailed Description when taken in connection with the accompanying Drawings, wherein.

DETAILED DESCRIPTION

Figure 1:
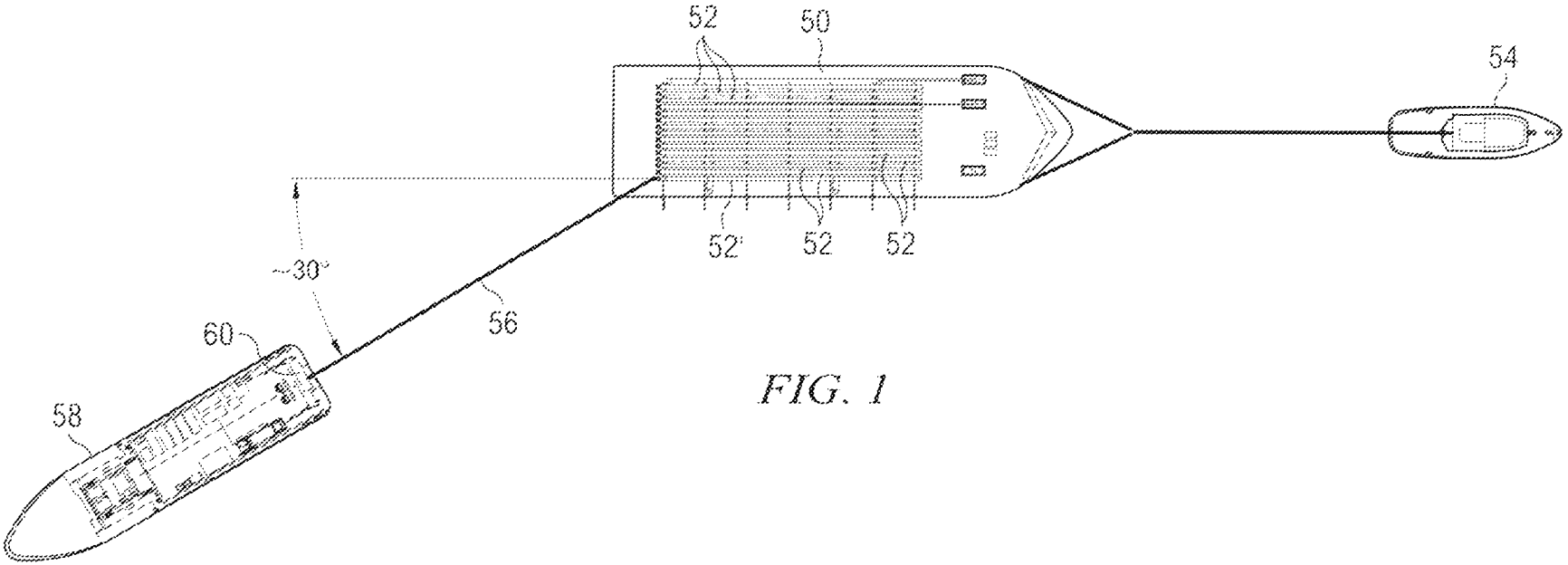
FIG. 1 is a plan view illustrating an anchor anchoring handling/tug/supply (AHTS) vessel, a supply barge, and a tug utilized in the practice of the invention.

Referring now to the Drawings, and particularly to FIG. 1, the vessels utilized in the practice of the invention are illustrated. A barge 50 is utilized to transport a plurality of conductor casings 52 to an offshore drilling venue. A tug 54 is employed to tow and position the barge 50 and the conductor casings 52 mounted thereon. A line 56 is connected to the upper end of the outermost conductor casing 52' located adjacent the starboard side of the barge 50. Line 56 extends to a winch mounted on an anchor handling/tug/supply (AHTS) vessel 58. As used herein the term AHTS vessel means a vessel characterized by a length of between about 200 feet and about 270 feet, a beam of between about 40 feet and about 55 feet, a gross weight of between about 1,000 tons and about 3,000 tons, and a carrying capacity of between about 2,000 tons and about 5,000 tons. Unlike most Construction Vessels the AHTS vessel 58 is not provided with a crane suitable for lowering objects to the seafloor. The AHTS vessel 58 is, however, provided with an A-frame 60.

Figure 2:
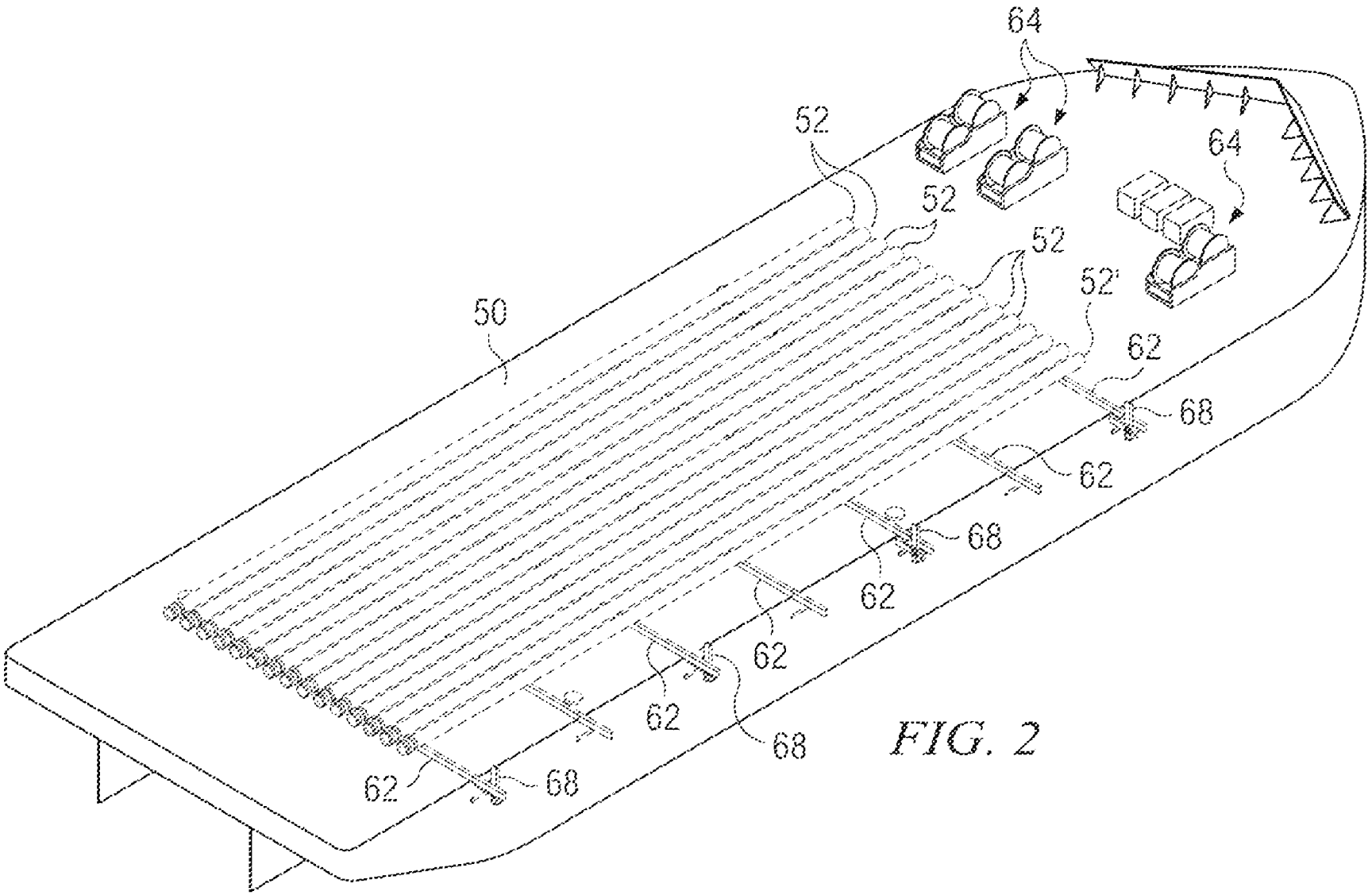
FIG. 2 is a perspective view further illustrating the barge of FIG. 1.

The barge 50 is shown in greater detail in FIG. 2. The conductor casings 52 are supported on a plurality of rails 62 which are in turn secured to the deck of the barge 50. The conductor casings are arranged on the rails 62 in a horizontal, parallel array. The lower end of each conductor casing 52 is located at the forward end of the barge 50 and the upper end of each conductor casing 52 is located at the aft end of the barge 50.

The barge 50 is provided with three double drum winches 64. Lines extending from the double drum winches 64 are used to control the movement of the conductor casings 52 relative to the deck of the barge 50 in a customary manner which is well known to those skilled in the art. Thus, one or more lines extending from one or more of the double drum winches 64 normally extend around all of the conductor casings 52 mounted on the deck of the barge 50 to prevent movement of the conductor casings relative to the deck of the barge 50. Whenever it is desired to unload the outermost conductor casing 52' from the barge 50 lines extending from one or more of the double drum winches 64 are extended around the conductor casing 52' in both directions thereby completely controlling the movement of the conductor casing 52' across the deck of the barge 50.

The steps involved in unloading a conductor casing 52' from the barge 50 are illustrated in FIGS. 1, 3, 4, 5, and 6. Referring momentarily to FIG. 1, the line 56 extending from the AHTS vessel 58 is secured to the upper end of the conductor casing 52' by a conventional connector which includes a swivel. The function of the swivel is to allow the conductor casing 52' to roll across the deck of the barge 50 on the rails 62 without twisting or tangling the line 56. The connection between the line 56 and the conductor casing 52' is omitted in FIGS. 3-6, inclusive, for clarity.

Figure 3:
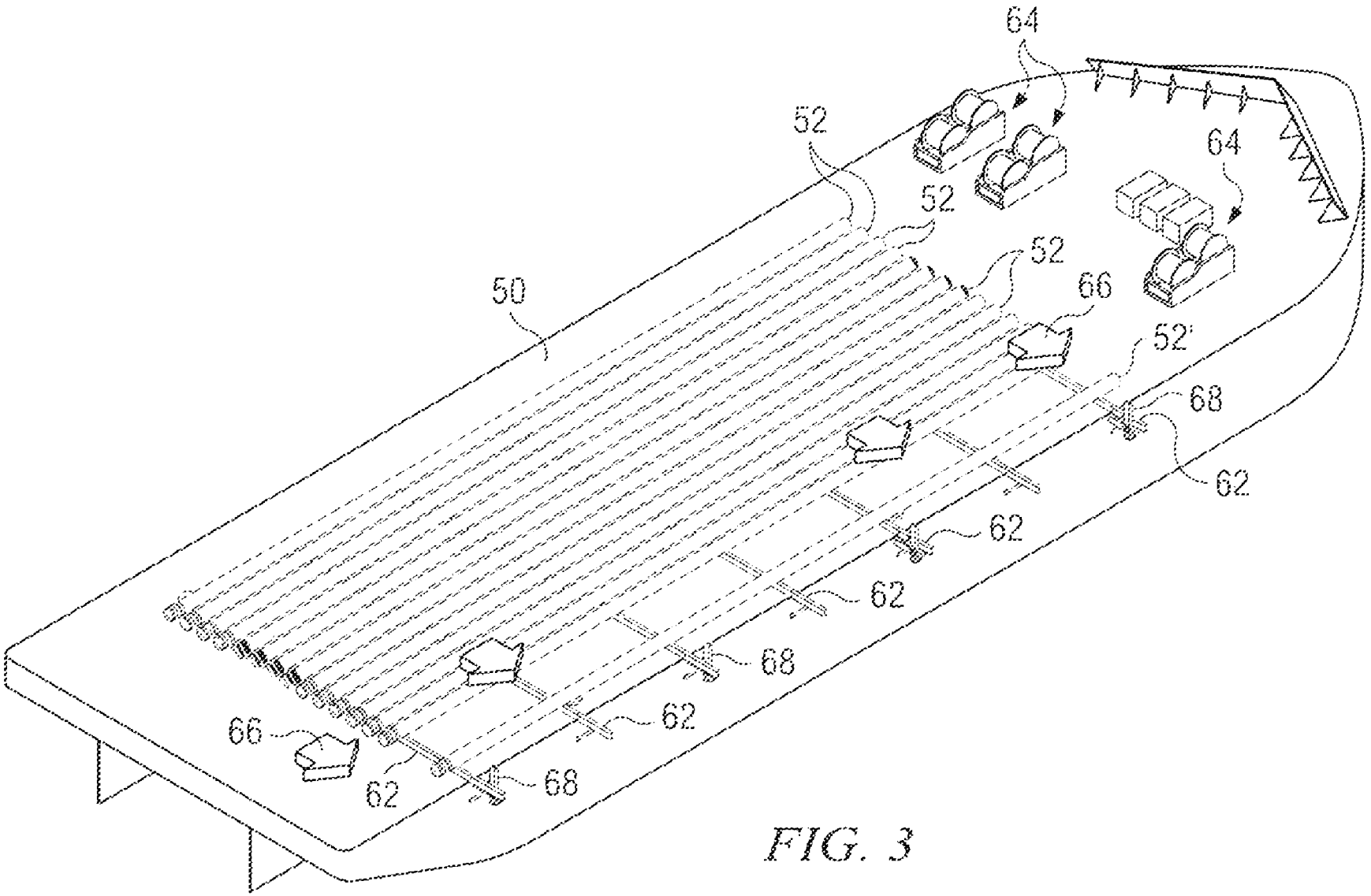
FIG. 3 is a view similar to FIG. 3 illustrating a first step in the unloading of a conductor casing from the barge.

Referring particularly to FIG. 3, unloading of the conductor casing 52' begins with rolling movement of the conductor casing 52' toward the starboard side of the barge 50 as indicated by the arrows 66. As indicated above, the rolling movement of the conductor casings 52' along the rails 62 is controlled by lines extending from one or more of the double drum winches 64. The lines extending from the double drum winches 64 are wrapped around the conductor casing 52' in opposite directions thereby completely controlling the movement of the conductor casing 52' relative to the deck of the barge 50.

Figure 4:
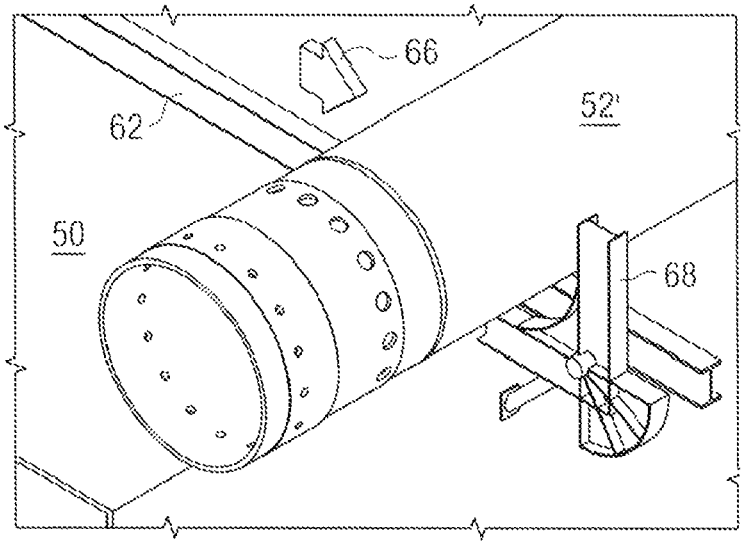
FIG. 4 is an illustration of a later step in the unloading of the conductor casing from the barge.
Figure 5:
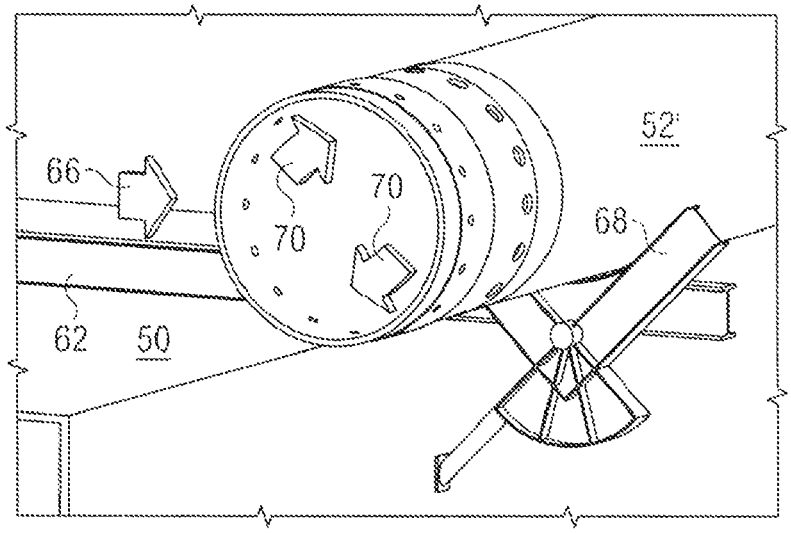
FIG. 5 is an illustration of a still later step in the unloading of the conductor casing from the barge.
Figure 6:
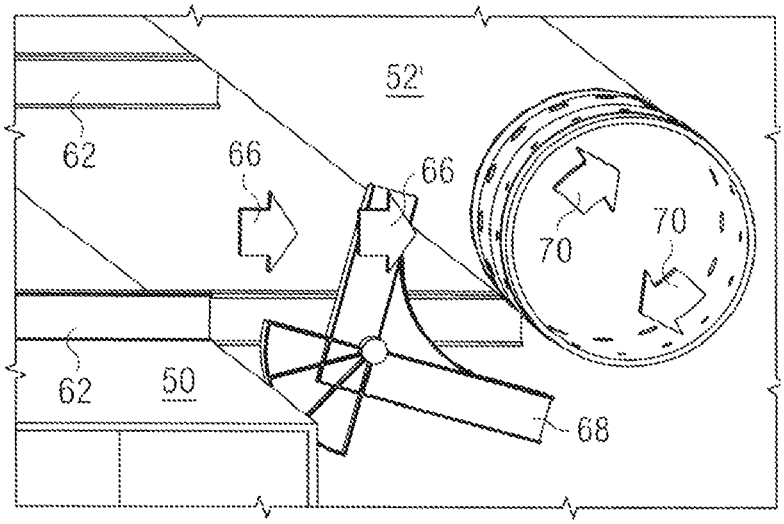
FIG. 6 is an illustration of the completion of the unloading of the conductor casing from the barge.

Referring to FIGS. 4, 5, and 6, as the conductor casing 52' reaches the ends of the rails 62 it engages a plurality of overboarding mechanisms 68. The overboarding mechanisms 68 initially stop the conductor casing 52' from rolling laterally as shown in FIG. 4 then receive the conductor casing 52' as shown in FIG. 5. At this point the cables extending from the double drum winches 64 which have been controlling the movement of the conductor casing 52' along the rails 62 are disengaged from the conductor casing 52'. Thereafter, when everything is in readiness for unloading the conductor casing 52' the overboarding mechanisms 68 are pivoted from the orientation shown in FIG. 5 through the orientation shown in FIG. 6 thereby allowing the conductor casing 52' to roll off the ends of the rails 62 and into the sea. The rolling movement of the conductor casing 52' is indicated in FIGS. 5 and 6 by the arrows 70.

Figure 7:
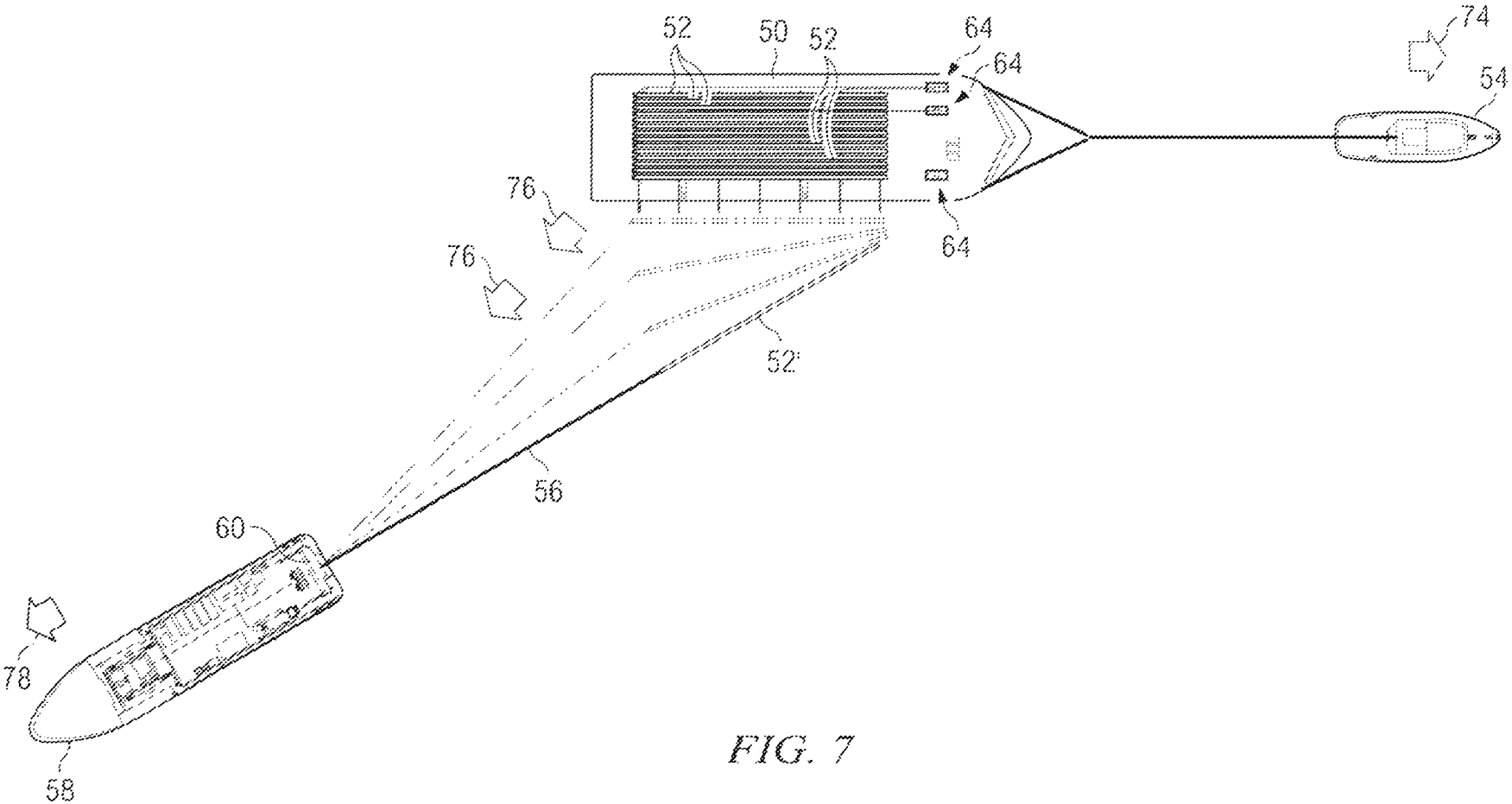
FIG. 7 is a view similar to FIG. 1 illustrating the relative movements of the AHTS vessel, the supply barge, and the tug during the movement of the conductor casing away from the barge under the action of a cable extending from the AHTS vessel to the conductor casing.
Figure 8:
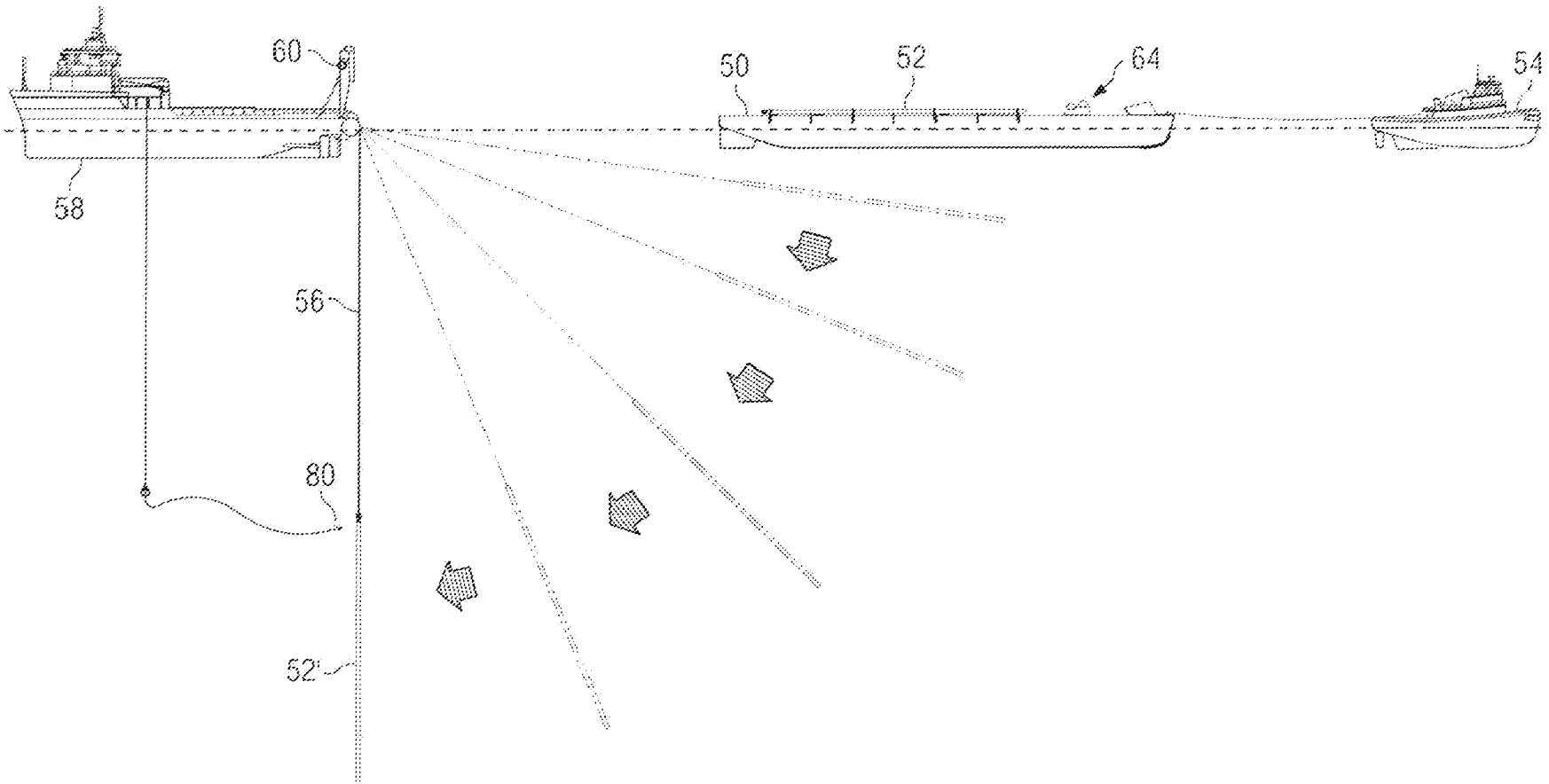
FIG. 8 is a side view illustrating the initial steps in the lowering of a conductor casing from the surface to the seafloor.

As will be appreciated by those skilled in the art the conductor casing 52' is unloaded from the barge 50 to facilitate the installation thereof in the seafloor. The initial steps in the conductor casing installation procedure of the present invention are illustrated in FIGS. 7 and 8. The tug 54 and the AHTS vessel 58 are operated in the directions indicated by the arrows 74 and 78, respectively. In this manner the conductor casing 52' is moved away from the barge 50 as indicated by the arrows 76 in FIG. 7. Meanwhile, the conductor casing 52' moves downwardly on the line 56 until it is oriented vertically as shown in FIG. 8. At this point the connection between the line 56 extending from the winch on the AHTS vessel 58 and the conductor casing 52' is observed by an ROV to assure that everything is in readiness for the completion of the installation procedure. The ROV also opens the port 106 and the vent valves 107 if they were initially closed.

Figure 9:
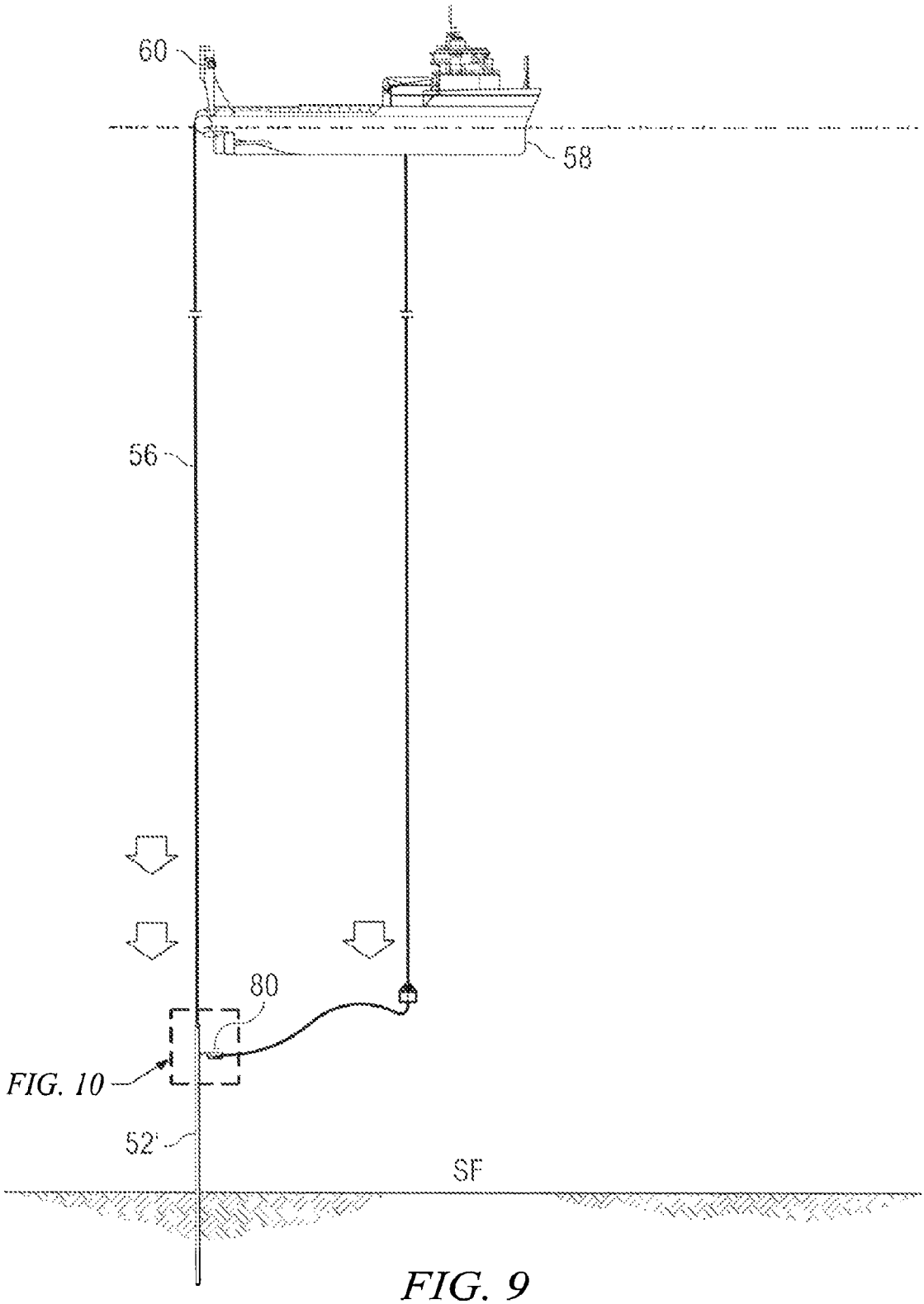
FIG. 9 is a side view illustrating an engagement of a conductor casing with the seafloor.
Figure 10:
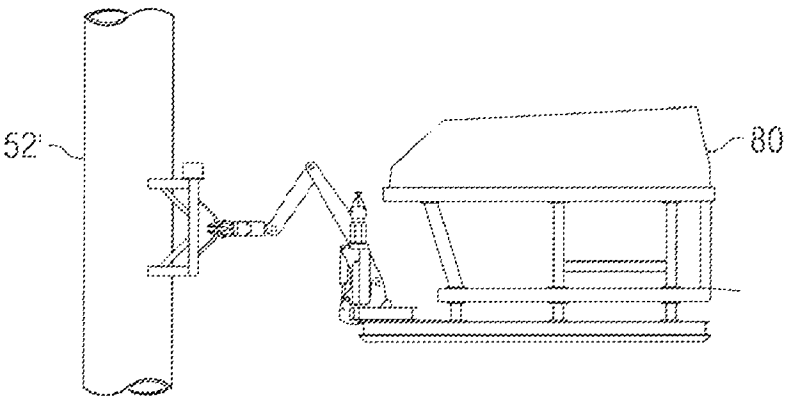
FIG. 10 is an enlargement of FIG. 9.

Referring to FIGS. 9 and 10, the winch on the AHTS vessel 58 pays out the line 56 until the conductor casing 52' engages and penetrates the seafloor SF under its own weight. At this point the ROV 80 engages the conductor casing 52" with an inclinometer in the manner illustrated in FIG. 10 to assure that the conductor casing 52' is orientated vertically within acceptable tolerance limits.

Figure 11:
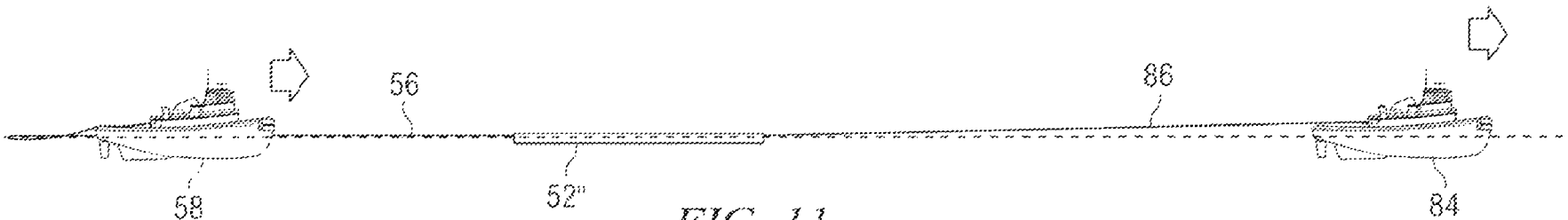
FIG. 11 is a side view illustrating a first step in an alternative method for deploying conductor casings to the seafloor.
Figure 12:
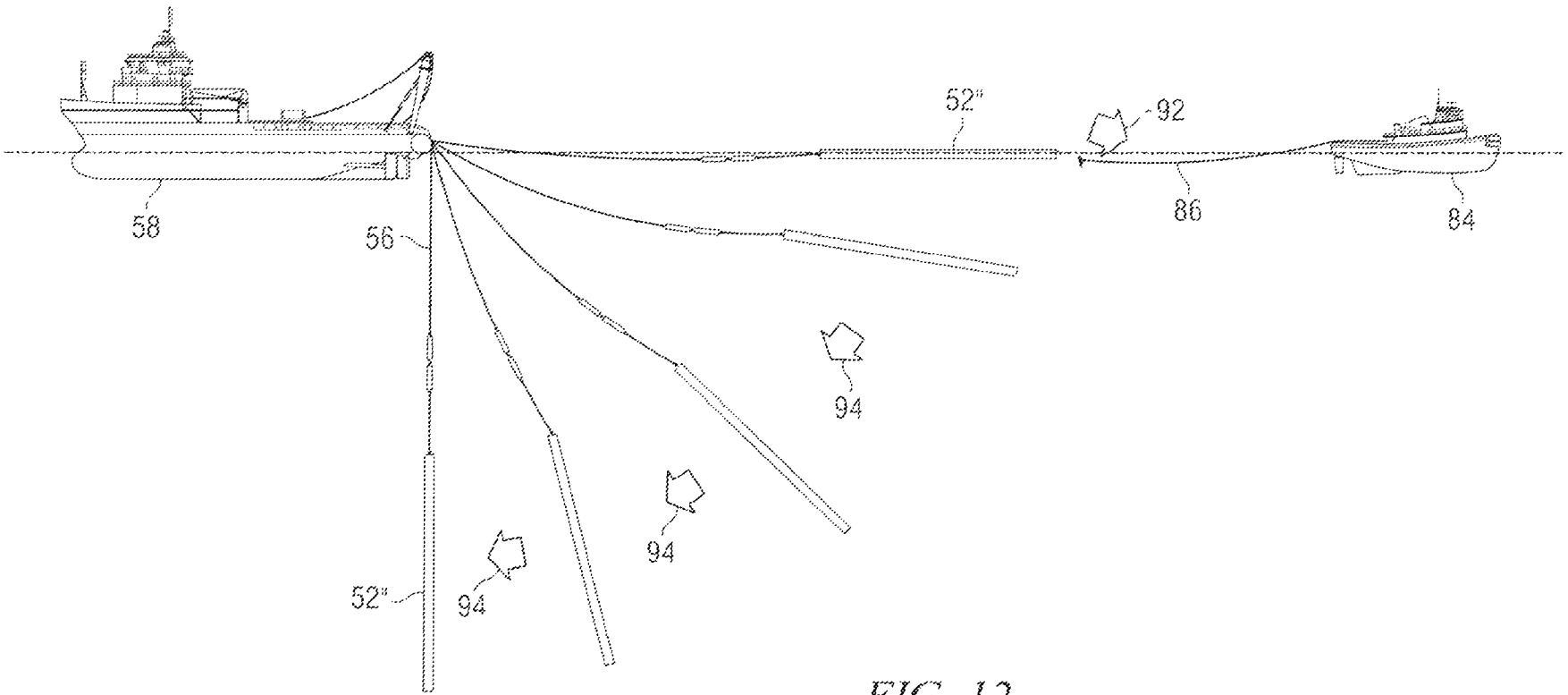
FIG. 12 is a side view illustrating later steps in the conductor casing deployment method of FIG. 11.

An alternative procedure for delivering conductor casings to an offshore drilling location is illustrated in FIGS. 11 and 12. A conductor casing 52" is plugged at both ends with so-called towheads while on shore or on the deck of a vessel. The lower end of the conductor casing 52" is connected to a tug 84 by a line 86. The AHTS vessel 58 is connected to the upper end of the conductor casing 52" by the line 56. The line 56 is in a slack condition during the towing of the conductor casing 52' by the tug 84.

Referring particularly to FIG. 12, when the conductor casing 52' is positioned at the specified offshore drilling venue the towhead at the lower end of the conductor casing 52" is removed and the line 86 is recovered onboard the tug 84 as indicated by the arrow 92. The conductor casing 52" floods with water then pendulates into a vertical orientation as indicated by the arrows 94.

Figure 13:
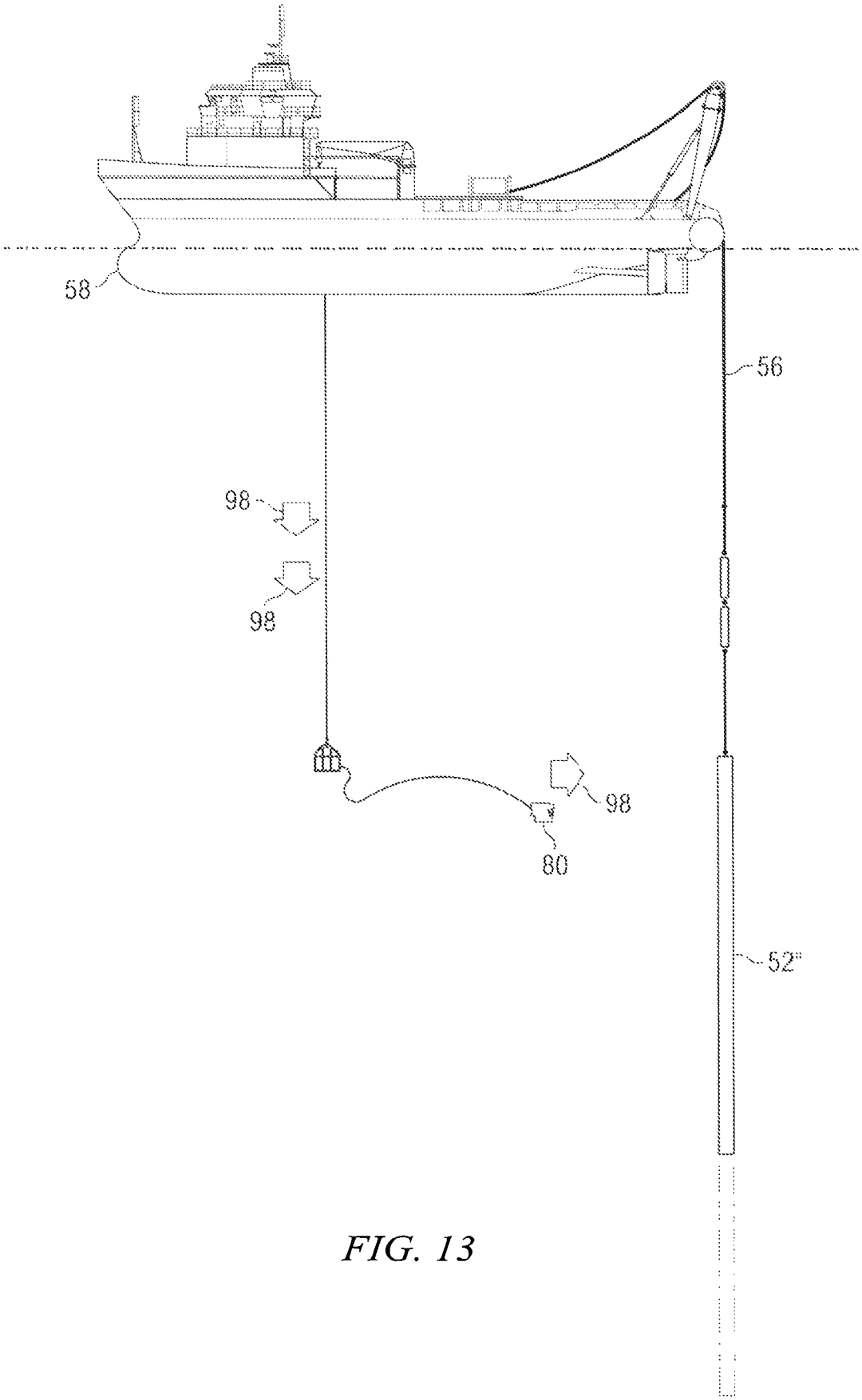
FIG. 13 is an illustration of the first step in a method of engaging a conductor casing with the seafloor by the application of suction thereto.
Figure 14:
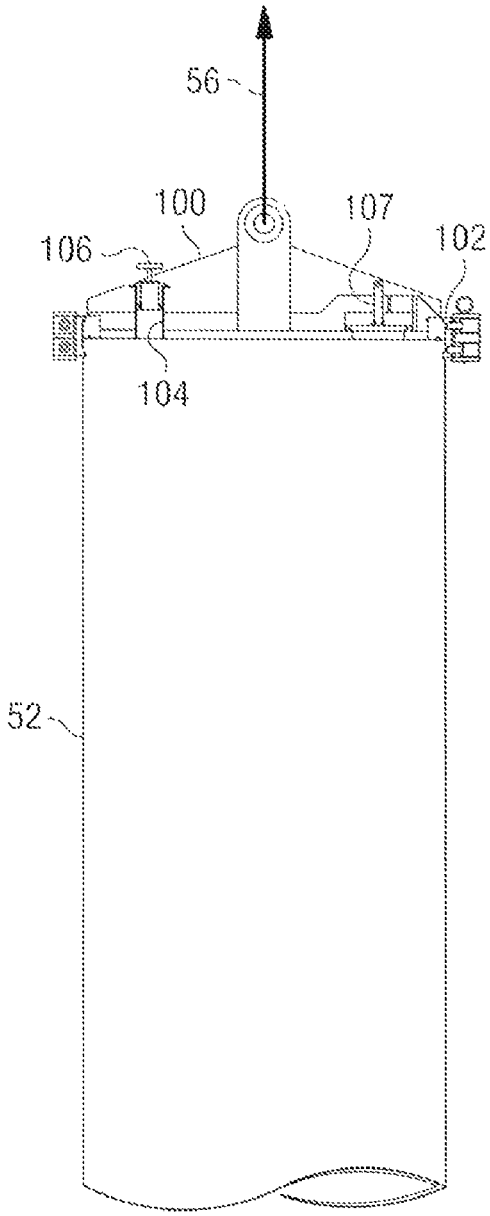
FIG. 14 is an illustration of a subsequent step in the method of FIG. 13.

Referring to FIG. 13, the ROV 80 is deployed from the AHTS vessel 58 as indicated by the arrows 98. The ROV 80 observes the line 56 and the connection between the line 56 extending from the AHTS vessel 58 and the conductor casing 52" to assure that everything is in readiness for installation of the conductor casing 52" into the seafloor SF. Thereafter the conductor casing 52" engages and penetrates the seafloor under its own weight and the vertical orientation thereof is checked by the ROV 80 in the manner illustrated in FIGS. 9 and 10 and described hereinabove in connection therewith.

If a particular casing 52 penetrates the seafloor sufficiently under its own weight to achieve stabilization no further action is required prior to hammering the conductor casing 52 to grade. If not a suction procedure may be employed to cause the conductor casing 52 to penetrate the seafloor sufficiently to achieve stabilization.

The suction procedure, known as Suction to Stabilization (STS), is illustrated in FIGS. 13 through 20, inclusive. Each conductor casing 52 is initially provided with a top plate 100 which is secured to the upper end of the conductor casing 52 by a latching mechanism 102. An inlet passageway 104 extends through the top plate 100. The top plate 100 is also provided with vent valves 107. The line 56 is secured to the top plate 100 and is utilized to lower the conductor casing 52 into engagement with the seafloor. The inlet port 104 and the vent valves 107 will be open if the conductor casing 52 was launched from the barge 50 as illustrated in FIGS. 2 through 10, inclusive, and described hereinabove in conjunction therewith. The inlet port 104 will be closed by a plug 106 and the vent valves 107 will also be closed if the conductor casing 52 was towed to the installation site as illustrated in FIGS. 11 and 12 and described hereinabove in conjunction therewith.

Figure 15:
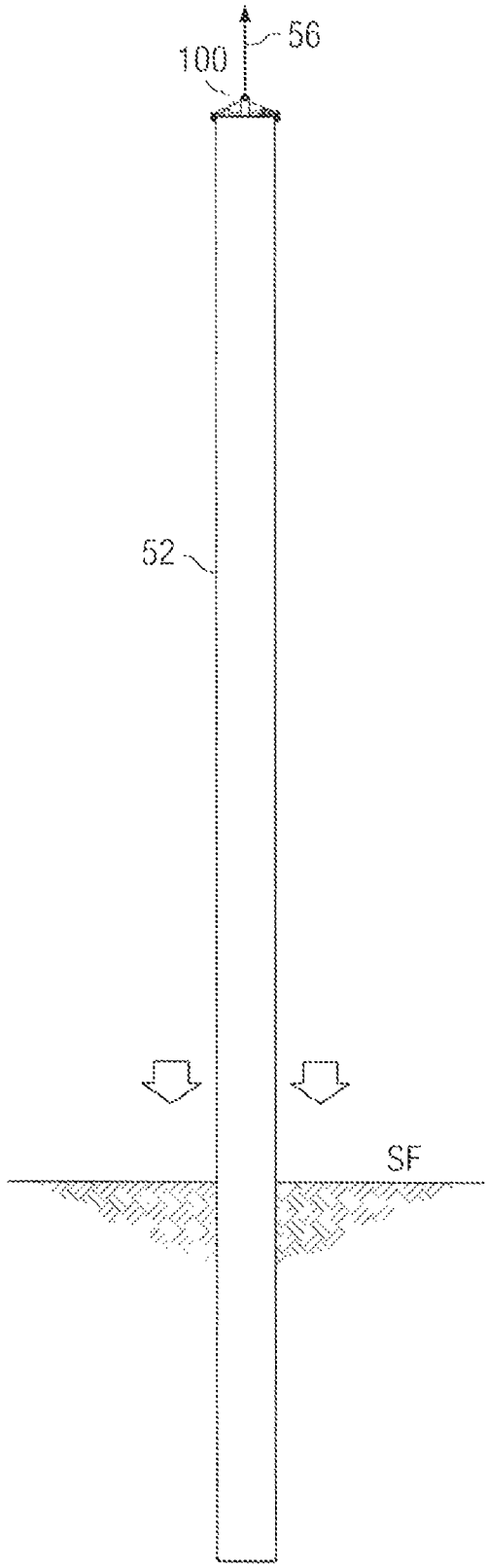
FIG. 15 is an illustration of a still later step in the method of FIG. 13.
Figure 16:
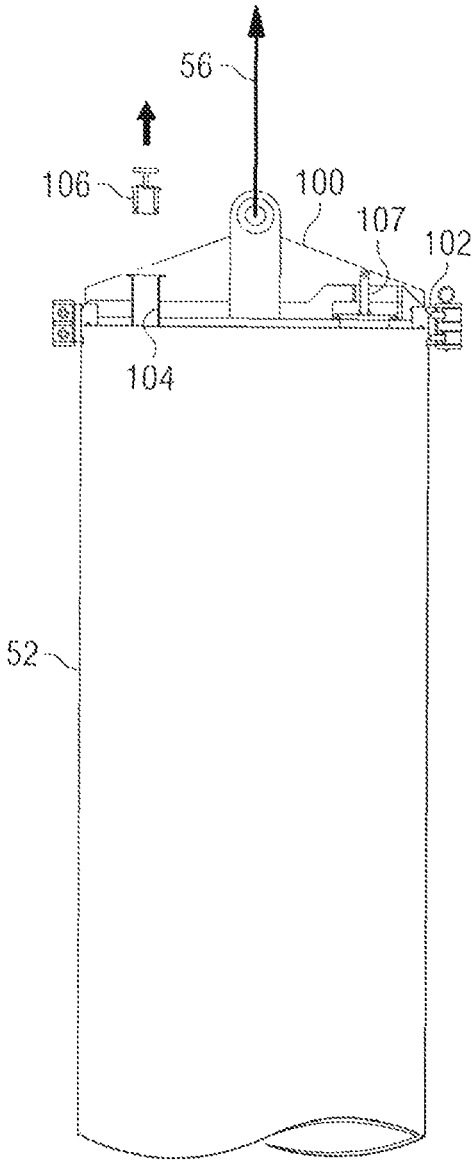
FIG. 16 is an illustration of a still later step in the method of FIG. 13.
Figure 17:
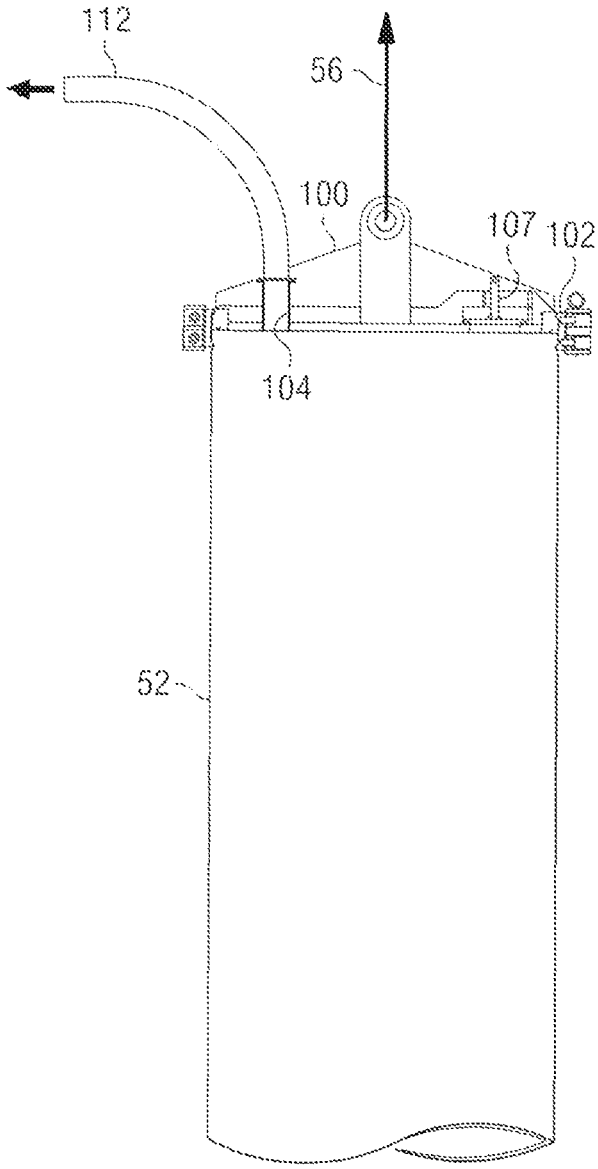
FIG. 17 is an illustration of a still later step in the method of FIG. 13.
Figure 18:
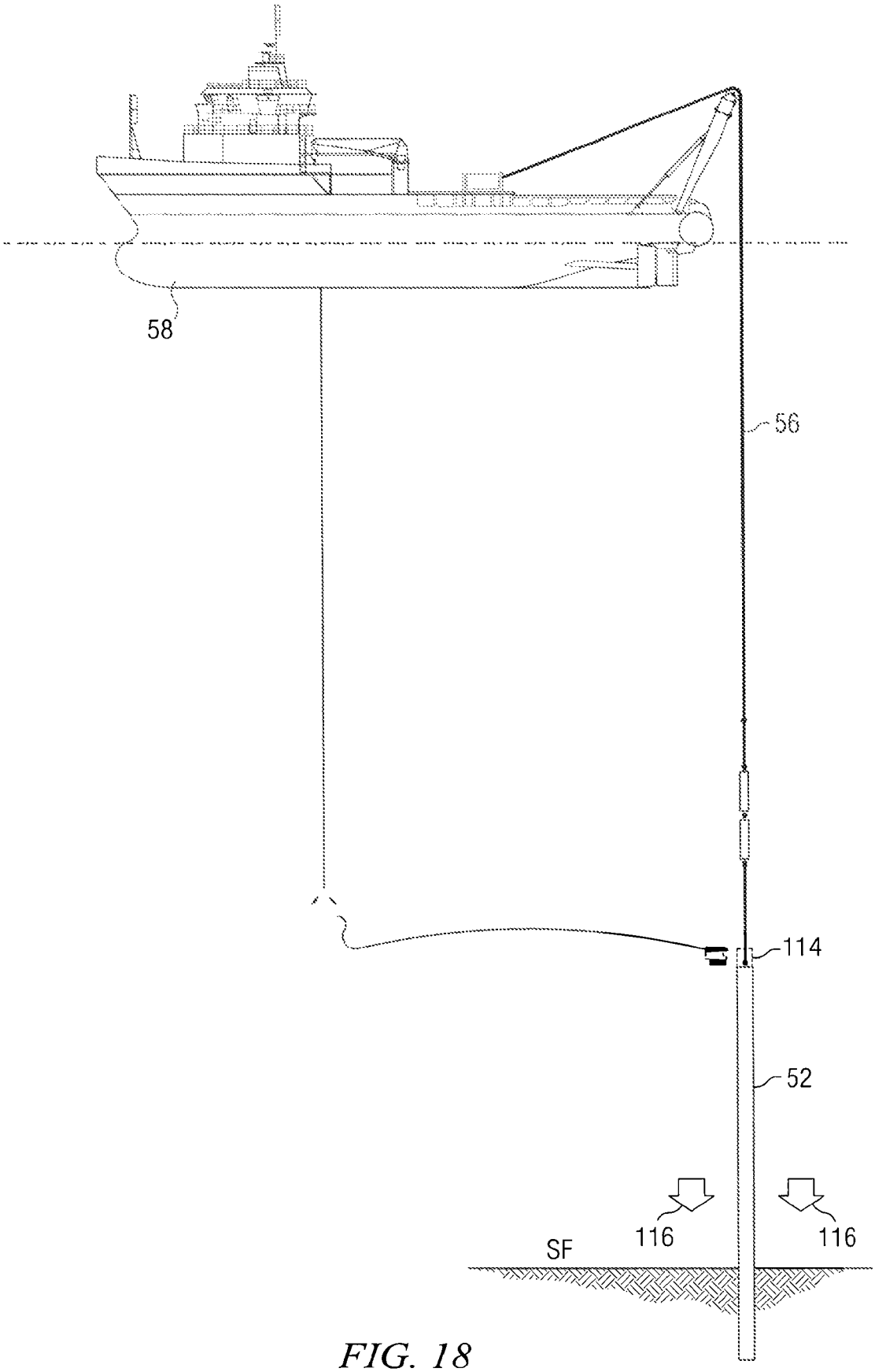
FIG. 18 is an illustration of a still later step in the method of FIG. 13.

FIG. 15 illustrates the initial penetration of the conductor casing 52 into the seafloor SF as a result of the weight of the conductor casing 52. If necessary the vent valves 107 are opened and the plug 106 is removed from the inlet port 104 as indicated in FIG. 16. A suction line 112 is connected to the inlet port 104 as indicated in FIG. 17. The suction line 112 functions to remove water from the interior of the conductor casing 52 creating an internal under-pressure whereupon the pressure of the sea on the top plate 100 forces the conductor casing 52 further into the seafloor. This causes the conductor casing to penetrate further into the seafloor SF as indicated in FIG. 18 at 114 and by the arrows 116.

Figure 20:
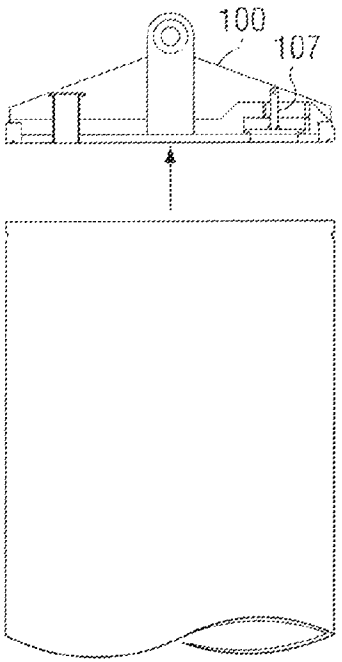
FIG. 20 is an illustration of a still later step in the method of FIG. 13.
Figure 19:
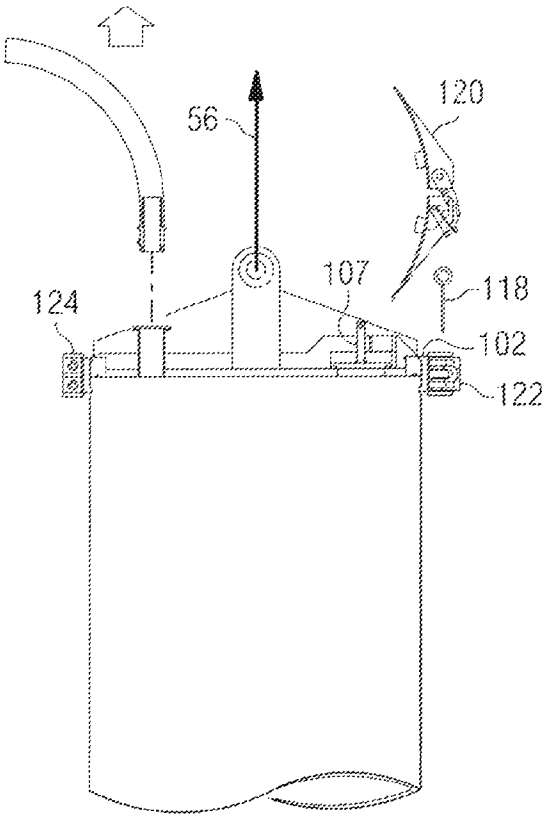
FIG. 19 is an illustration of a still later step in the method of FIG. 13.

The conductor casing 52 is penetrated into the seafloor as far as possible while maintaining adequate factors of safety under the application of the suction to the interior thereof thereby achieving stability. An ROV is then utilized to remove a pin 118 thereby disengaging the latching mechanism 102. The pin 118 and the additional component parts 120, 122, and 124 comprising the latching mechanism are recovered to the surface. The top plate 100 is then disengaged from the upper end of the conductor casing 52 and recovered to the surface as indicated in FIG. 20.

Figure 22:
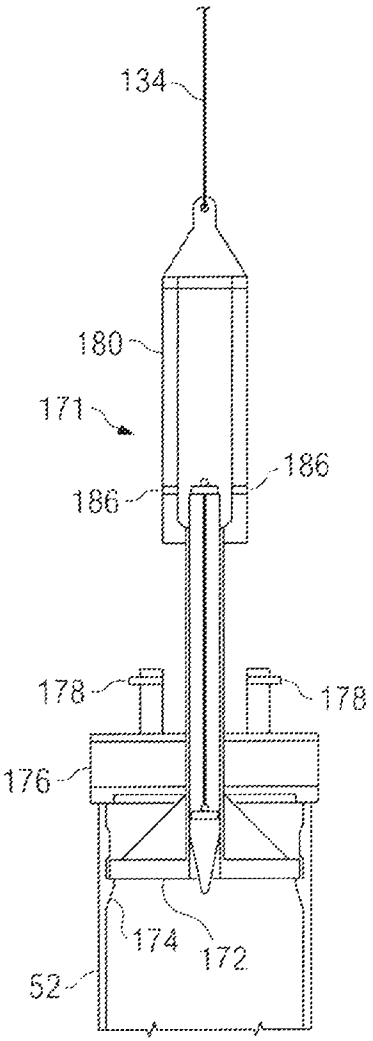
FIG. 22 is an illustration of a second step in the operation of the drop hammer of FIG. 21.
Figure 21:
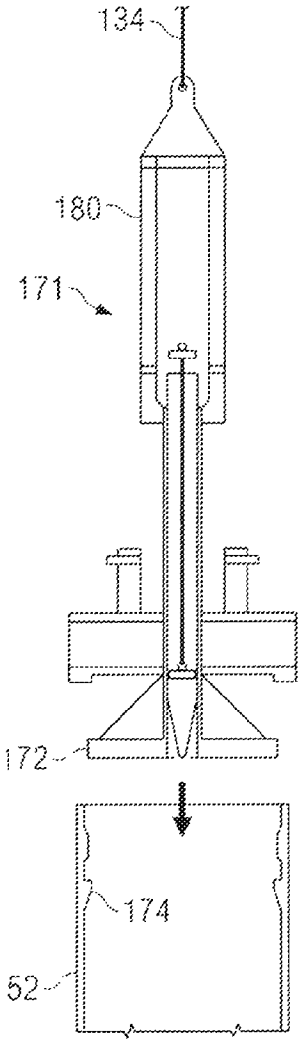
FIG. 21 is an illustration of a first step in the operation of a drop hammer.

In lieu of the foregoing STS procedure a drop hammer 171 may be employed to achieve conductor casing stability. Operation of the drop hammer to drive the conductor casings 52 into the seafloor is illustrated in FIGS. 21 through 27, inclusive. The drop hammer is lowered on the line 134 into engagement with a conductor casing 52 to be partially driven into the seafloor until a plate 172 located at the bottom of the hammer 130 engages a hammer receiving profile 174 within the conductor casing 52 in the manner illustrated in FIG. 22. The drop hammer 130 includes a weight 176 which is provided with connecting pins 178. After the plate 172 is engaged with the profile 174 as indicated in FIG. 22, a steel cylinder 180 is moved downwardly as indicated by the arrows 182 in FIG. 23. When the cylinder 180 engages the weights 176 the pins 178 are moved inwardly as indicated by the arrows 184 in FIG. 23 and are engaged with apertures 186 formed in the cylinder 180. At this point the anchor winch on the AHTS 58 is employed to move the cylinder 180 and the weight 176 upwardly on the line 134 in the manner indicated in FIG. 24 by the arrows 188.

Figure 26:
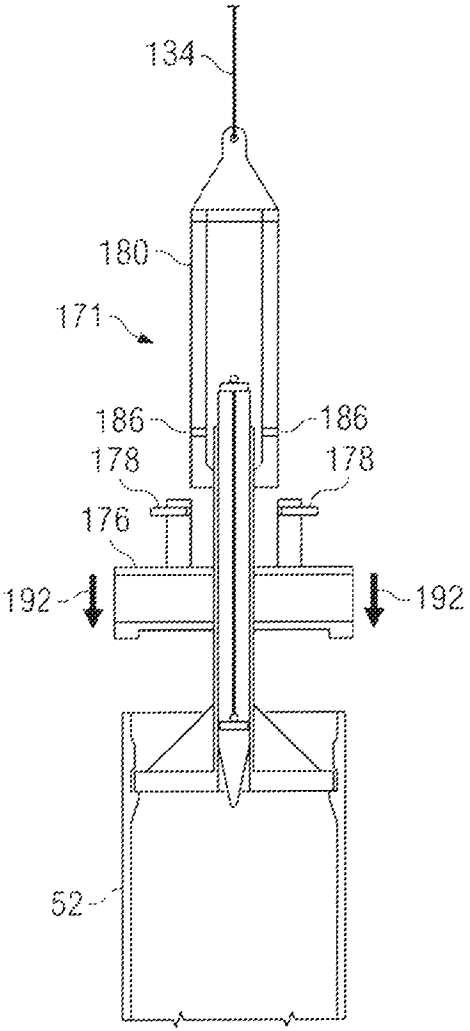
FIG. 26 is an illustration of a sixth step in the operation of the drop hammer.
Figure 25:
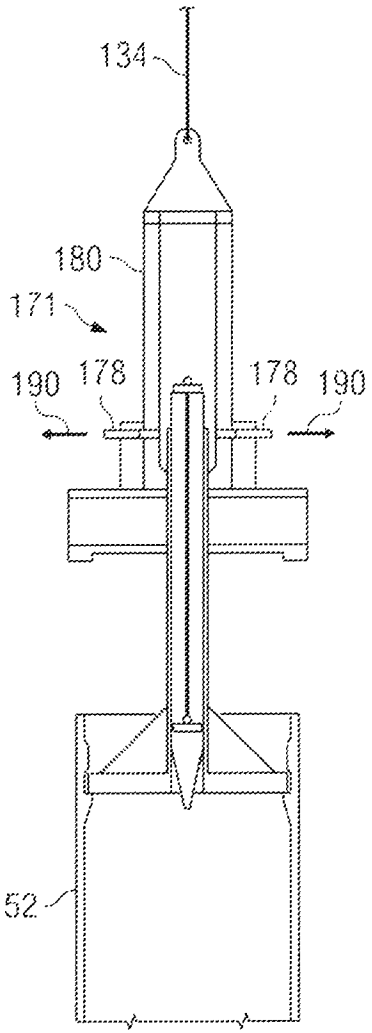
FIG. 25 is an illustration of a fifth step in the operation of the drop hammer.
Figure 24:
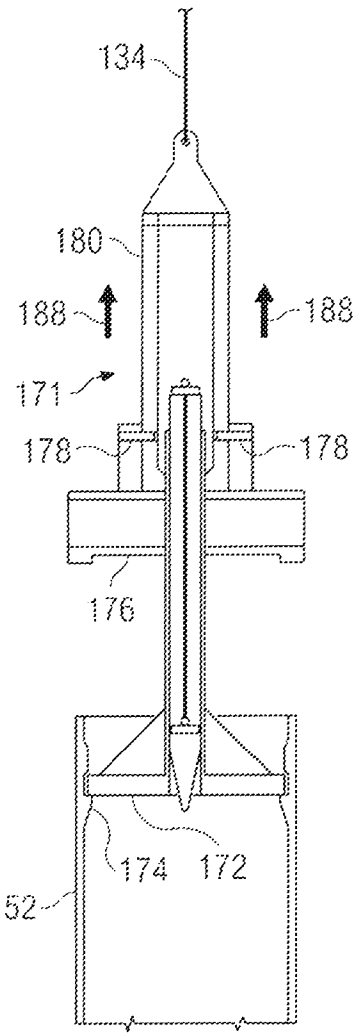
FIG. 24 is an illustration of a fourth step in the operation of the drop hammer.
Figure 23:
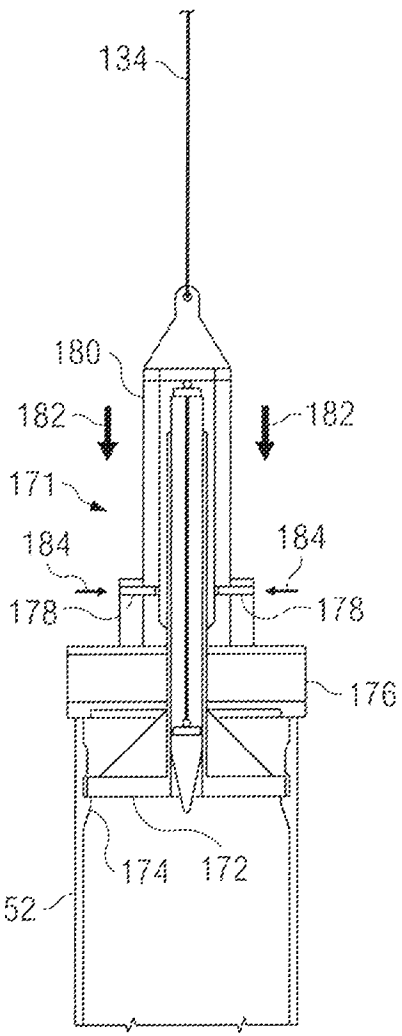
FIG. 23 is an illustration of a third step in the operation of the drop hammer.
Figure 27:
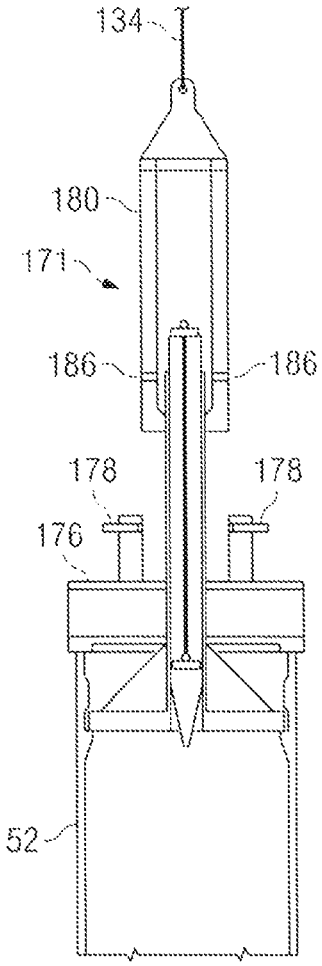
FIG. 27 is an illustration of a seventh step in the operation of the drop hammer.

Referring to FIGS. 25, 26, and 27, when the cylinder reaches the top of its travel the pins 178 are withdrawn from the apertures 186 as indicated by the arrows 190 in FIG. 25. This allows the weight 176 to fall downwardly under the action of gravity as indicated by the arrows 192 in FIG. 26. The weight 176 strikes the top of the conductor casing 52 as indicated in FIG. 27 thereby driving the conductor casing 52 further into the seafloor SF. The operating cycle of the drop hammer 130 as illustrated in FIGS. 22 through 27, inclusive, is repeated until the conductor casing 52 is driven to stable penetration depth.

Figure 28:
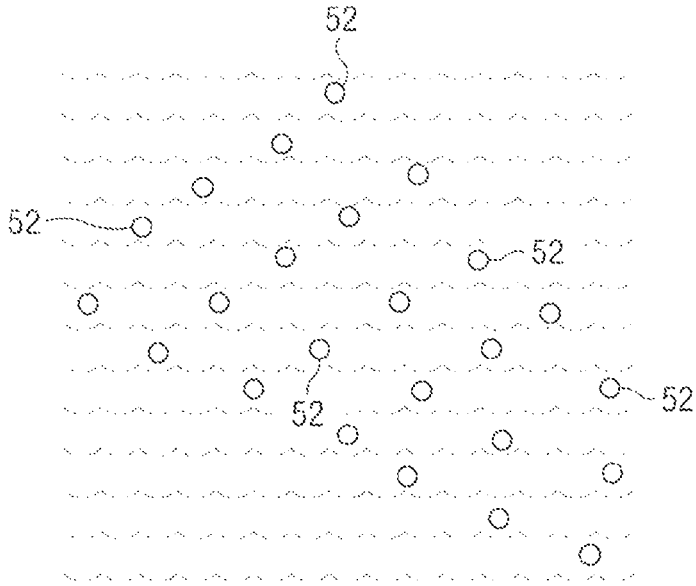
FIG. 28 is an illustration of the installation of the multiplicity of conductor casings in the seafloor.

FIG. 28 depicts an array of conductor casings 52 following initial engagement thereof with the seafloor SF. At this point each of the conductor casings 52 has penetrated the seafloor either to a first depth resulting solely from the weight of the conductor casing 52 or to a second stabilization depth resulting either from the application of suction to the interior of the conductor casing 52 as illustrated in FIGS. 14 through 20, inclusive, and described hereinabove in conjunction therewith or from the use of the drop hammer 171 is illustrated in FIGS. 21 through 27, inclusive, and described hereinabove in connection therewith. In accordance with the present invention all of the conductor casings 52 comprising the array thereof to be deployed at a particular offshore drilling venue are installed prior to any of the conductor casings 52 being driven to its working depth in the seafloor SF.

After all of the conductor casings 52 have been installed in the seafloor and stabilized as necessary the AHTS vessel 58 is demobilized from the conductor casing unloading and installation configuration illustrated in FIGS. 1 through 10, inclusive. Utilization of the barge 50 and the tub 54 as illustrated in FIG. 1 is no longer required. The AHTS vessel 56 is thereafter re-mobilized in the hydraulic pile driving hammer transportation and utilization configuration illustrated in FIG. 29.

Figure 29:
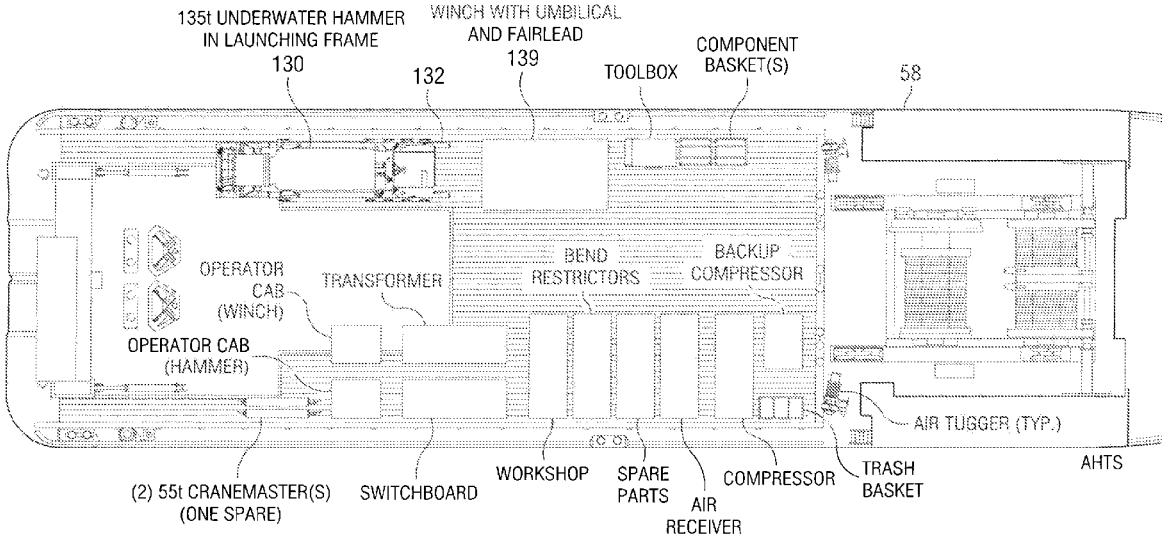
FIG. 29 is an illustration of a typical hydraulic hammer spread layout on the deck of the AHTS vessel.
Figure 30:
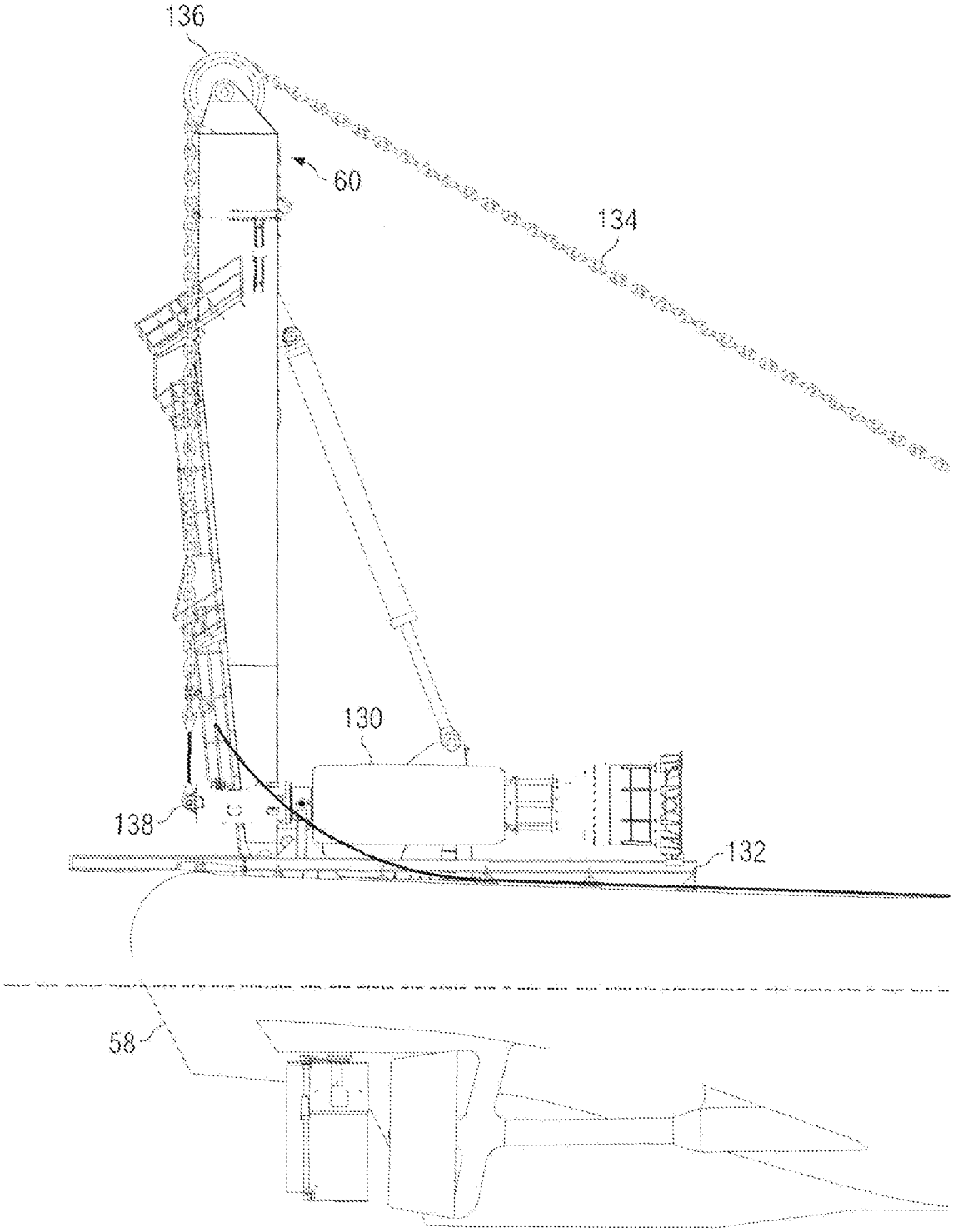
FIG. 30 is an illustration of an initial step in the deployment of the hydraulic pile driving hammer from the deck of the AHTS vessel to the seafloor.

FIG. 29 through 36 illustrate the deployment of a hydraulic pile driving hammer 130 from the deck of the AHTS vessel 58 to the seafloor all of which are conventional and well known to those skilled in the art. The hydraulic pile driving hammer 130 is initially supported on a skid 132 and is located for transport from port to a selected offshore drilling venue as illustrated in FIG. 29. Upon arrival of the AHTS vessel 58 at the offshore drilling venue the hydraulic pile driving hammer 130 and the skid 132 are relocated to a position beneath the A-frame 60 of the AHTS vessel as shown in FIG. 30. A line 134 is extended over a sheave 136 located at the top of the A-frame 60 and is connected to the top of the hydraulic pile driving hammer 130 at 138.

Figure 31:
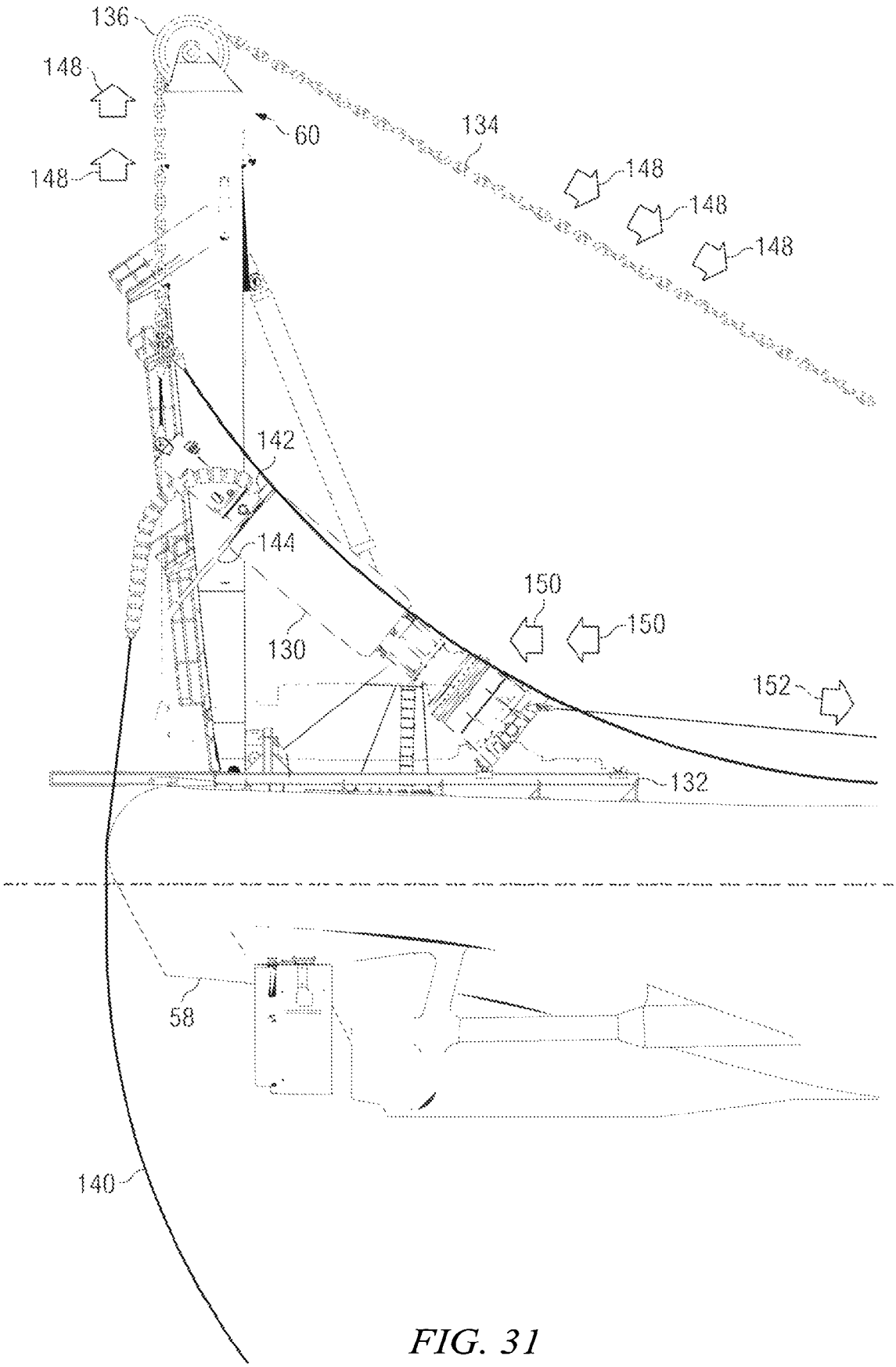
FIG. 31 is an illustration of a subsequent step in the deployment of the hydraulic pile driving hammer from the deck of the AHTS vessel to the seafloor.
Figure 32:
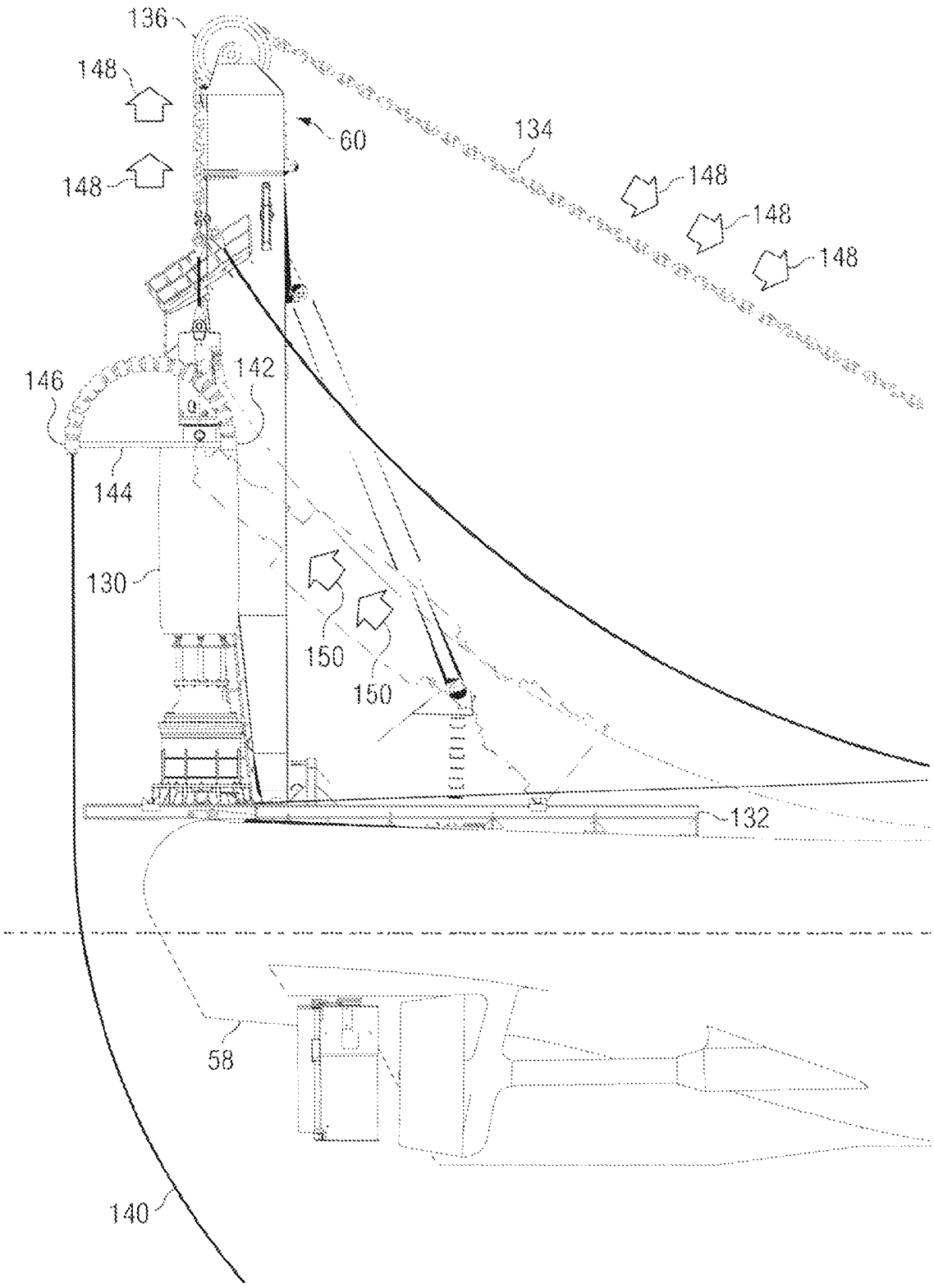
FIG. 32 is an illustration of a still later step in the deployment of the hydraulic pile driving hammer from the deck of the AHTS vessel to the seafloor.

The steps involved in up-righting the hydraulic hammer 130 prior to the deployment thereof into the sea are illustrated in FIGS. 31 and 32. An umbilical which supplies pressurized air and electrical power to the hydraulic pile driving hammer 130 extends from an umbilical winch 139 on the AHTS vessel 58 and is secured to the top of the hydraulic pile driving hammer at 142. An arm 144 extends laterally from the hydraulic pile driving hammer and is connected to the umbilical 140 at 146. The line 134 is drawn inwardly as indicated by the arrows 148 in FIGS. 31 and 32 thereby lifting the hydraulic pile driving hammer 130 from the position shown in FIG. 30 through the position shown in FIG. 31 to the position shown in FIG. 32 as indicated by the arrows 150. Movement of the hydraulic pile driving hammer 130 is controlled by a winch mounted on the AHTS vessel 58 which applies a resisting force to the bottom of the hydraulic pile driving hammer 130 in the direction of the arrow 152.

Figure 33:
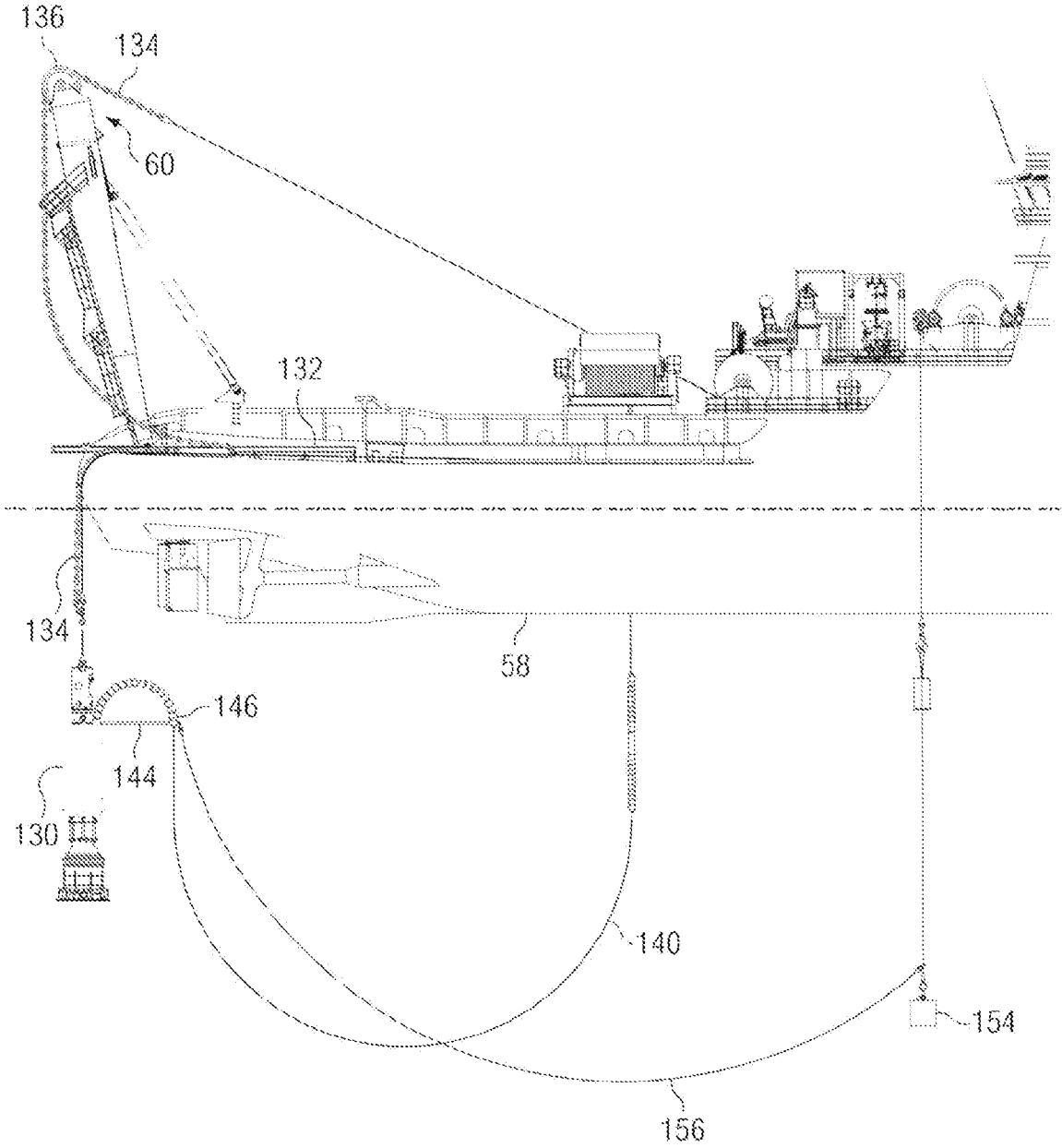
FIG. 33 is an illustration of a still later step in the deployment of the hydraulic pile driving hammer from the deck of the AHTS vessel to the seafloor.

Referring to FIG. 33 a clump weight 154 is deployed from the AHTS vessel 58 and is connected to the arm 144 at location 146 by a line 156. The function of the clump weight 154 and the line 156 is to prevent rotation of the hydraulic pile driving hammer 130 as it is lowered into the sea which could result in tangling of the umbilical 140 either around the hydraulic pile driving hammer 130 or around the hammer lowering line 56.

Figure 34:
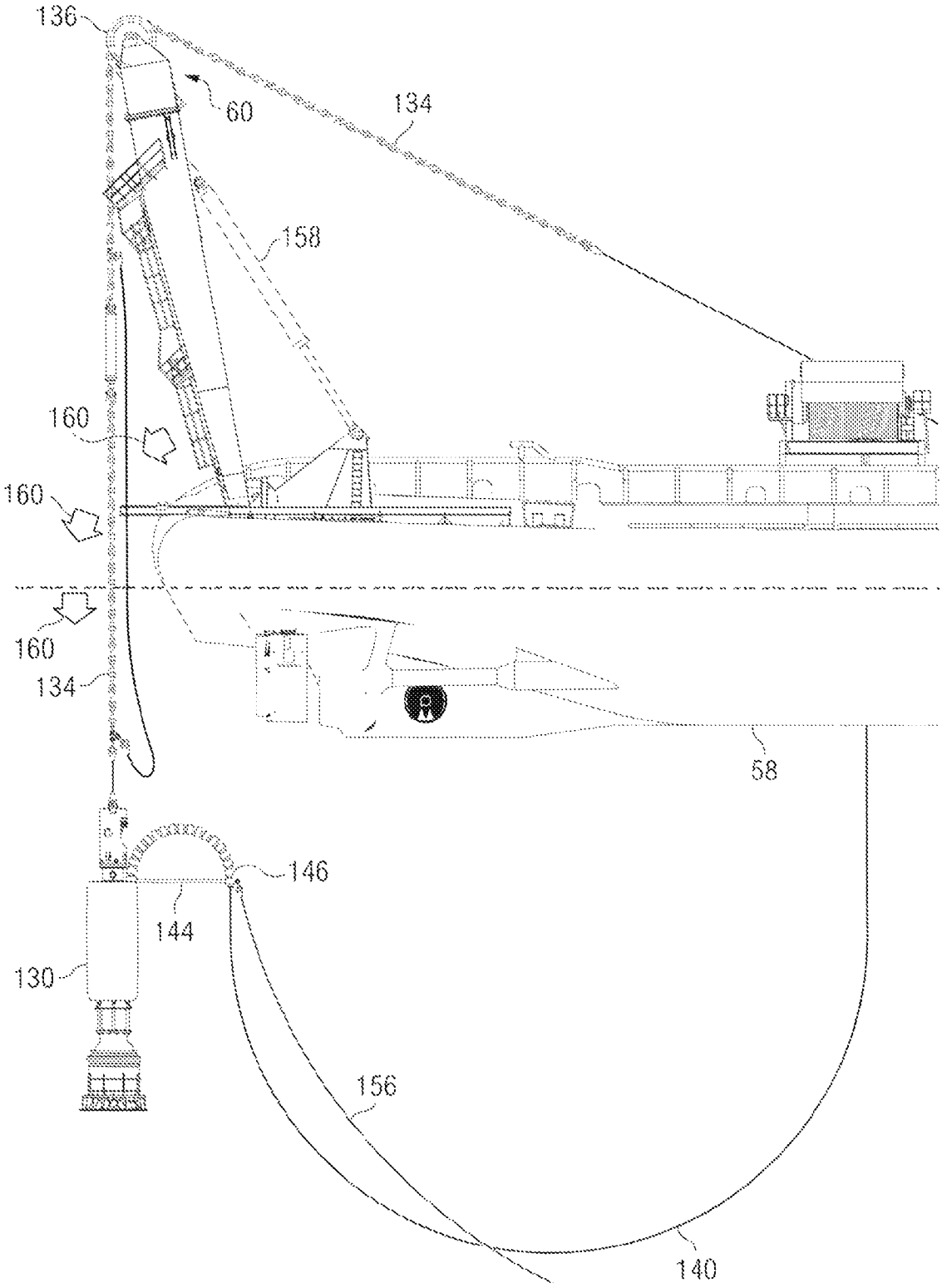
FIG. 34 is an illustration of a still later step in the deployment of the hydraulic pile driving hammer from the deck of the AHTS vessel to the seafloor.
Figure 35:
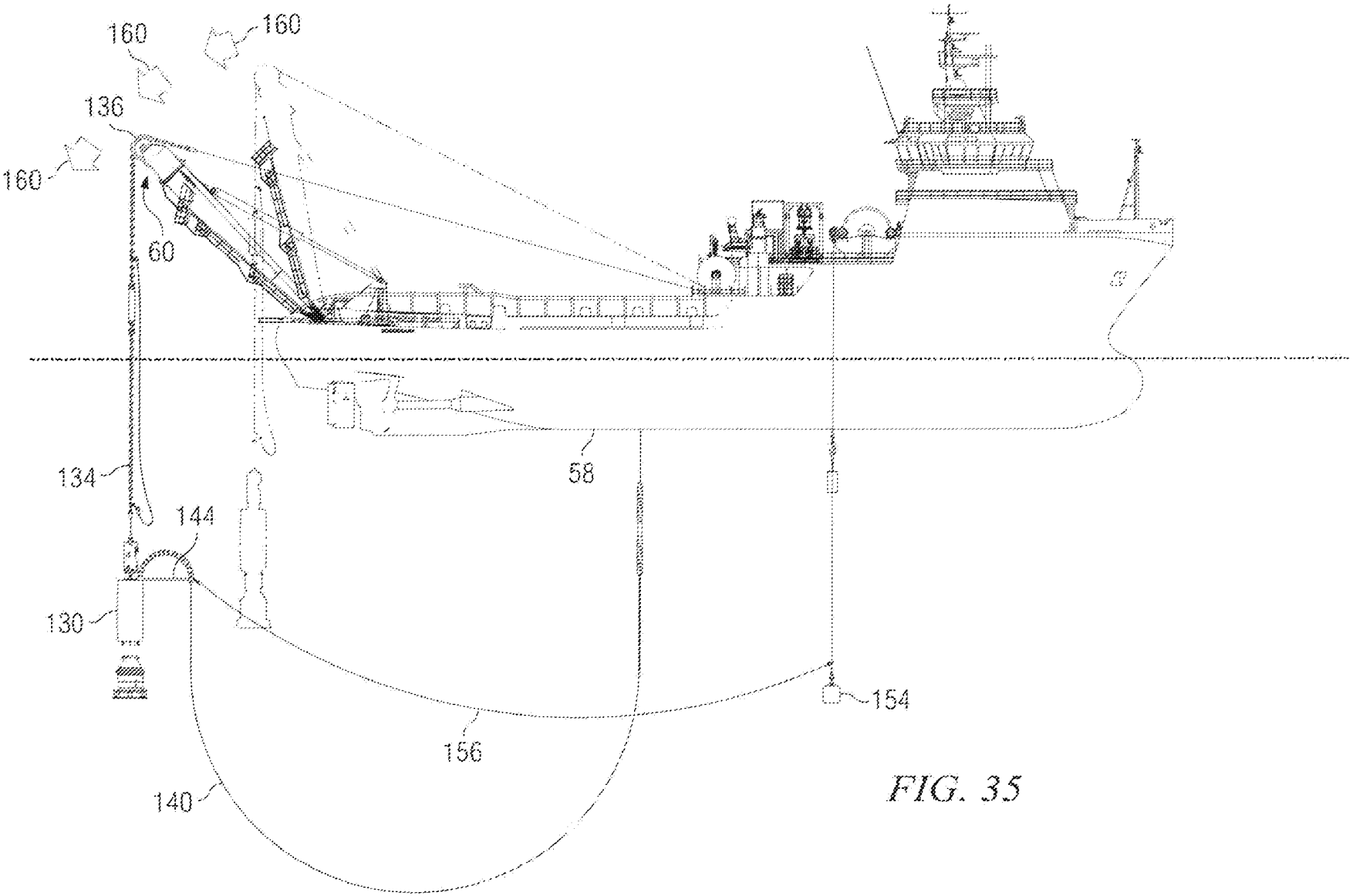
FIG. 35 is an illustration of a still later step in the deployment of the hydraulic pile driving hammer from the deck of the AHTS vessel to the seafloor.

Subsequent steps in the deployment of the hydraulic pile driving hammer 130 into the sea are illustrated in FIGS. 34 and 35. The A-frame 60 is pivoted aft under the action of a hydraulic cylinder 158 as indicated by the arrows 160. The line 156 extending from the clump weight 154 to the arm 144 remains taut thereby substantially eliminating any possible rotation of the hydraulic pile driving hammer 130 as it is lowered into the sea.

Figure 36:
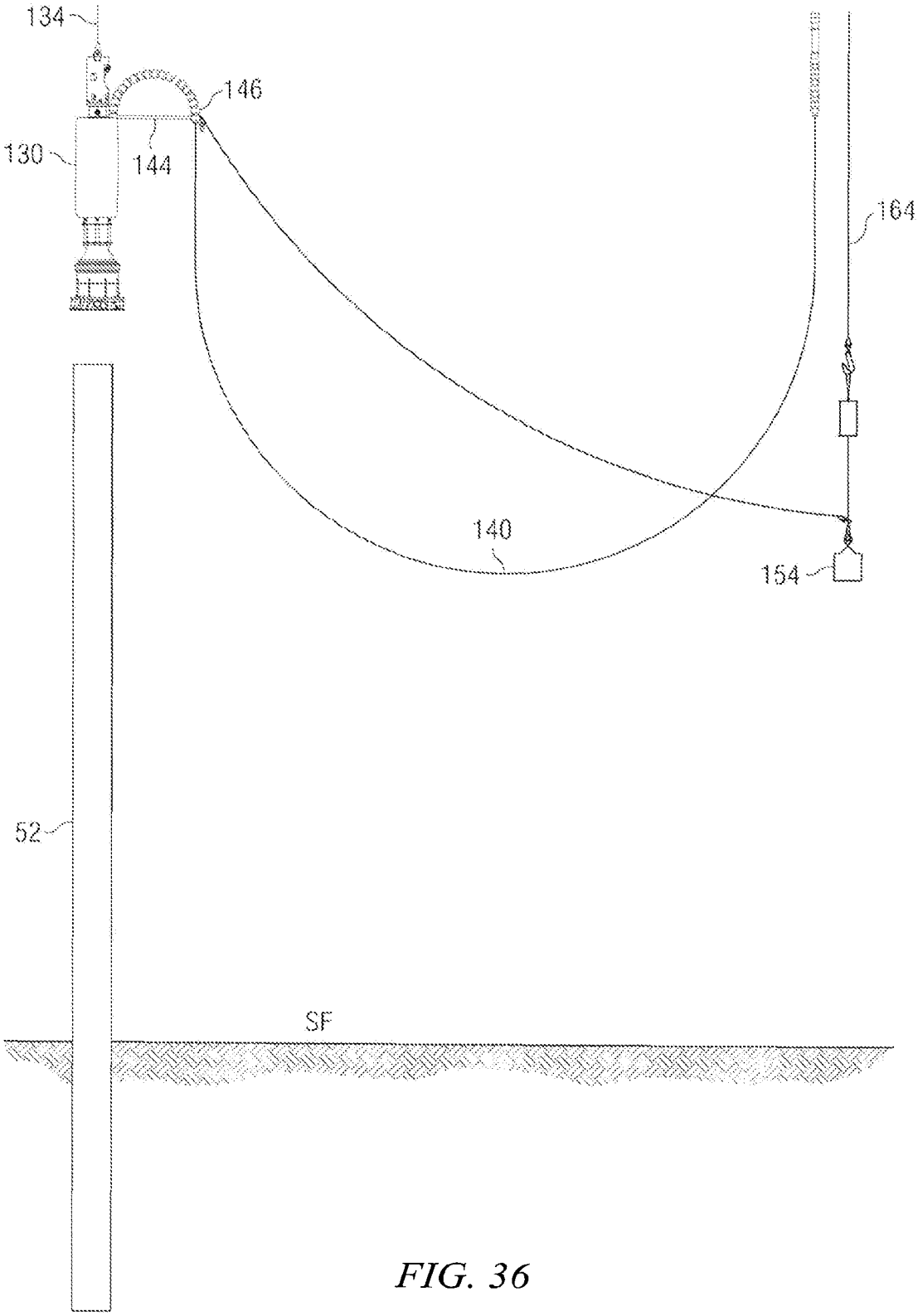
FIG. 36 is an illustration of a first step in the engagement of the hydraulic pile driving hammer with the upper end of a conductor casing previously engaged with the seafloor.
Figure 37:
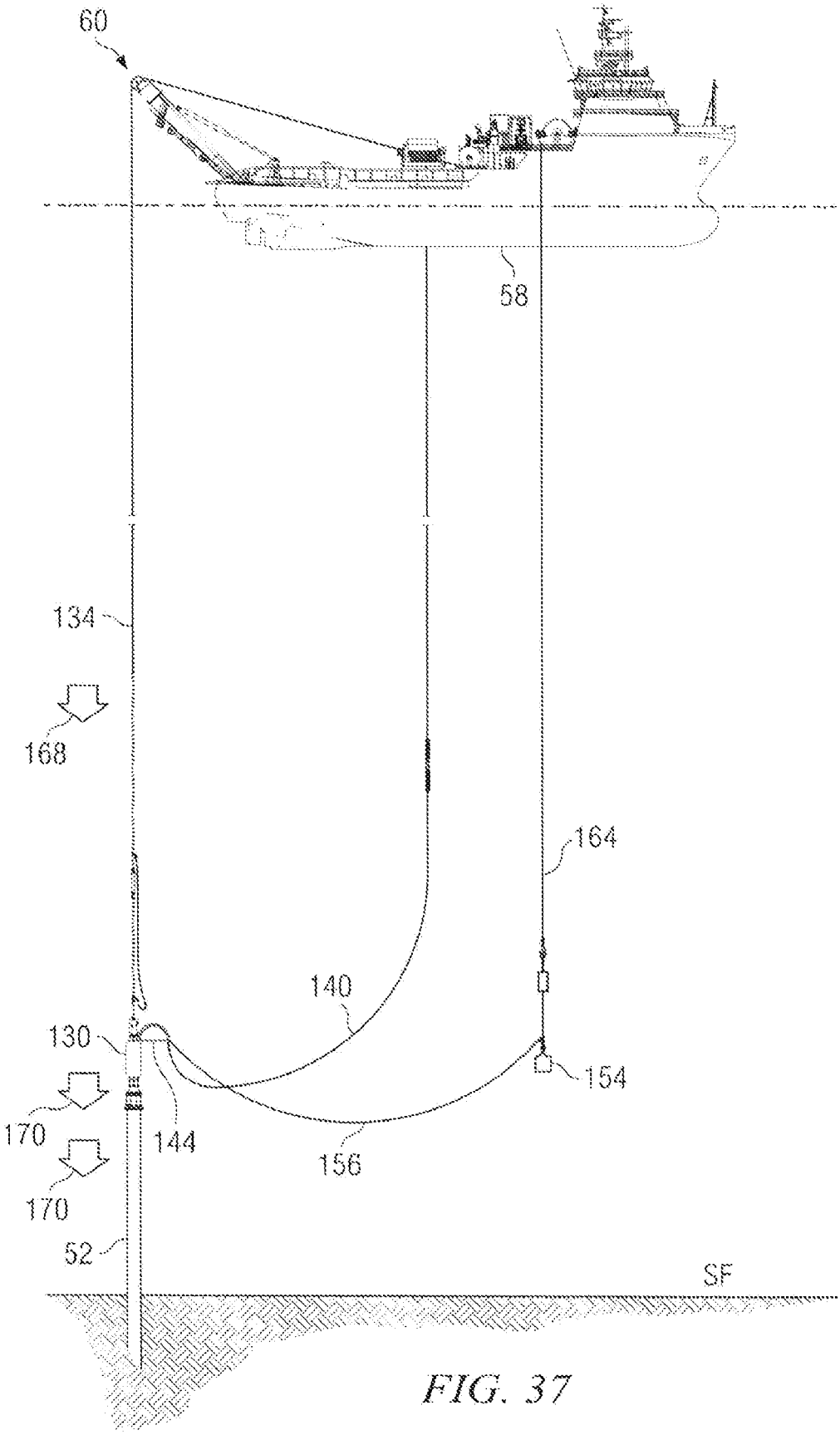
FIG. 37 is an illustration of the use of the hydraulic pile driving hammer to fully engage the conductor casing with the seafloor.

FIG. 36 illustrates the positioning of the hydraulic pile driving hammer 130 just above a conductor casing 52 which has previously been engaged with the seafloor SF as described hereinabove. FIG. 37 illustrates lowering of the hydraulic pile driving hammer 130 into engagement with the previously installed conductor casing 152 as indicated by the arrow 168 and the use of the hydraulic pile driving hammer 132 to drive the conductor casing 52 into the seafloor SF as indicated by the arrows 170.

Figure 38:
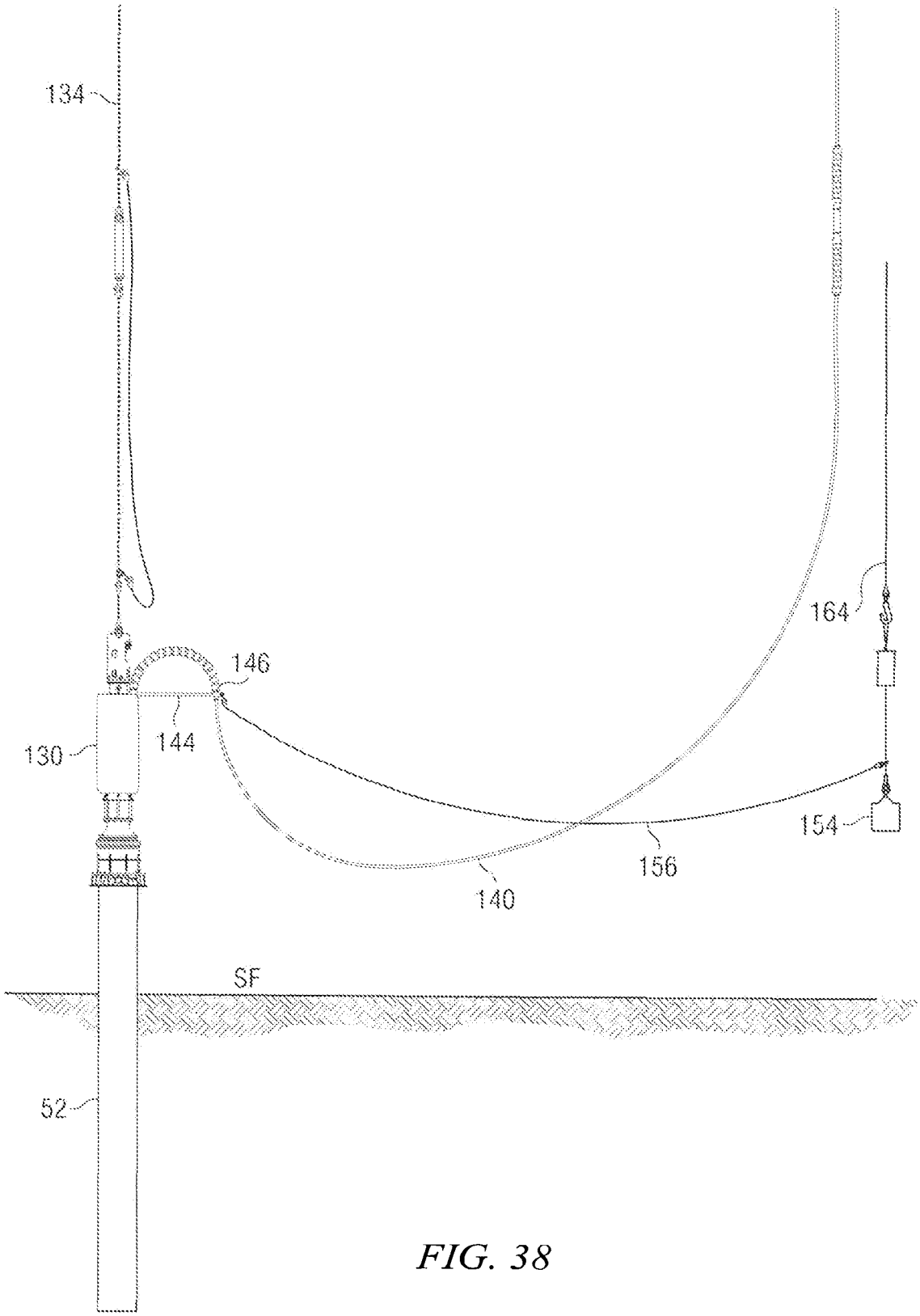
FIG. 38 is an illustration of the completion of the engagement of the conductor casing with the seafloor under the action of the hydraulic pile driving hammer.
Figure 39:
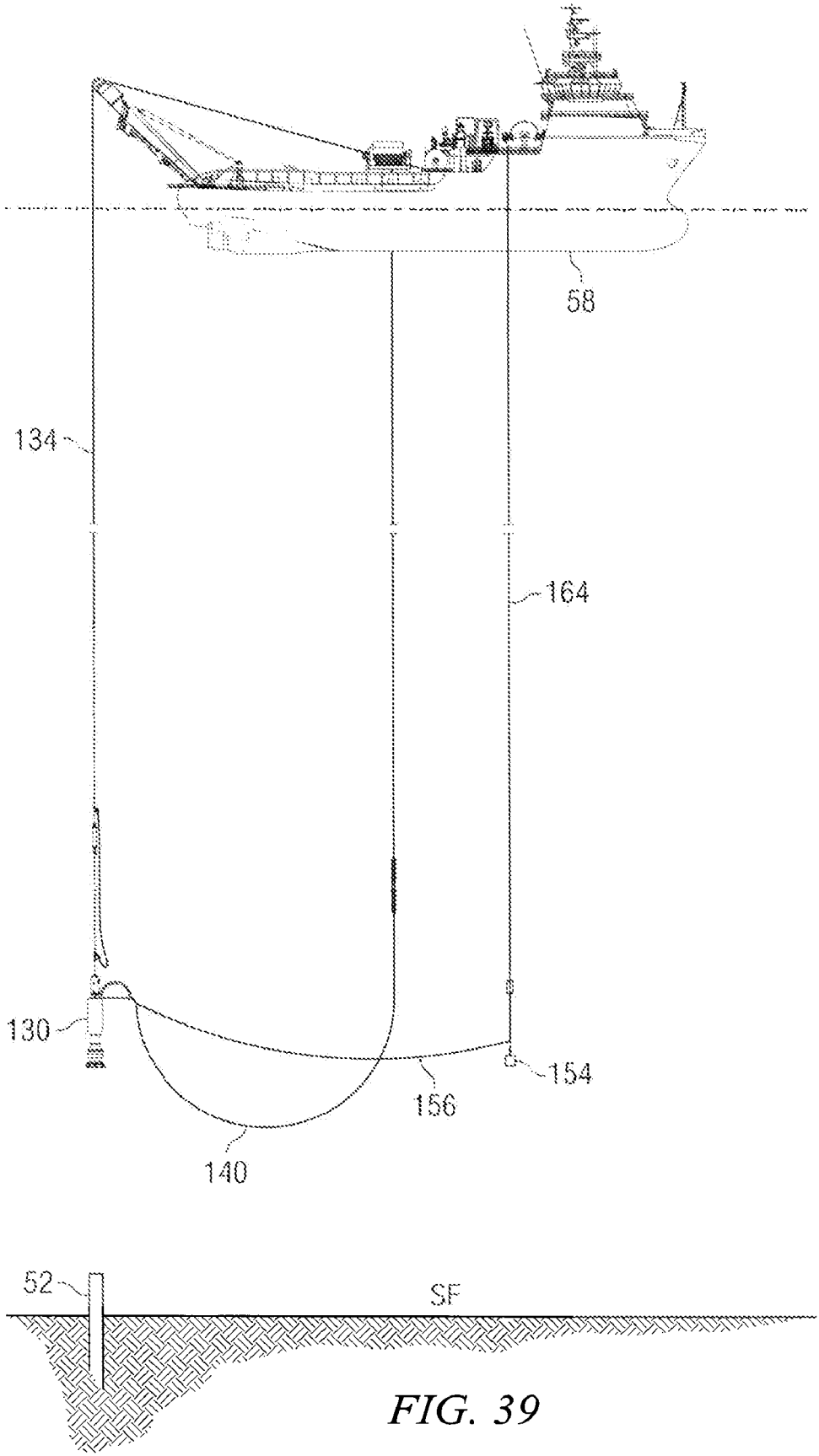
FIG. 39 is an illustration of the movement of the hydraulic pile driving hammer from the location of a first conductor casing to the location of a different conductor casing comprising an array thereof.

FIG. 38 illustrates the conductor casing 52 driven to grade by operation of the hydraulic pile driving hammer 130. The line 134 is partially withdrawn to lift the hydraulic pile driving hammer 130 a predetermined distance above the seafloor SF. The umbilical winch on the AHTS vessel 150 is operated to partially withdraw the umbilical 140, and the clump weight lowering line 164 is partially withdrawn to lift the clump weight 154 a predetermined distance above the seafloor SF, thereby positioning the hydraulic pile driving hammer 130, the umbilical 140, and the clump weight 154 as shown in FIG. 39. When the foregoing steps are completed all of the components illustrated in FIG. 39 except the conductor casing 52 which is now driven to grade in the seafloor SF are relocated to position the hydraulic pile driving hammer 130 in engagement with another conductor casing 52 comprising an array of conductor casings 52 located at a particular offshore drilling venue. An important feature of the present invention comprises the fact that the hydraulic pile driving hammer 130 is not recovered on the AHTS vessel 58 until all of the conductor casings comprising an array thereof at a particular offshore drilling venue have been driven to grade.

Although preferred embodiments of the invention have been illustrated in the accompanying Drawings and described in the foregoing Detailed Description, it will be understood that the invention is not limited to the embodiments disclosed, but is capable of numerous rearrangements, modifications, and substitutions of parts and elements without departing from the spirit of the invention.

The invention claimed is:

1. A method of installing conductor casings at a designated location on the seafloor comprising the steps of:

providing a plurality of conductor casings;

providing a vessel having a winch mounted thereon;

providing an elongate flexible member selected from the group consisting of cables, chains and ropes;

winding the elongate flexible member onto the winch;

providing a barge;

initially positioning the plurality of conductor casings on the barge;

connecting the distal end of the elongate flexible member to a first of the plurality of conductor casings on the barge;

removing the first conductor casing from the barge and thereafter utilizing the winch and the elongate flexible member to lower the first conductor casing to the seafloor at a predetermined drilling location thereon;

utilizing the weight of the first conductor casing to initially embed the conductor casing into the seafloor;

providing a source of suction;

connecting the source of suction to the first of the conductor casings following the initial embedding thereof in the seafloor and thereby further embedding the conductor casings into the seafloor;

removing the distal end of the elongate flexible member from the first conductor casing and attaching the distal end to a second conductor casing;

removing the second conductor casing from the barge and thereafter utilizing the winch and the elongate flexible member to lower the second conductor casing to the seafloor at a predetermined drilling location thereon to from an array of conductor casings on the seafloor;

utilizing the weight of the second conductor casing to initially embed the conductor casing into the seafloor;

connecting the source of suction to the second of the conductor casings following the initial embedding thereof in the seafloor and thereby further embedding the conductor casing into the seafloor;

removing the distal end of the elongate flexible member from the second conductor and placing the remainder of the plurality of conductors into predetermined drilling locations with the winch and elongate flexible members to form an array of conductor casings initially embedded into the seafloor under the weight of the casings and then further embedded into the seafloor under the application of suction to the conductor casings;

providing a hydraulic pile driving hammer;

initially positioning the hydraulic pile driving hammer on the vessel;

after the array of conductor casings has been formed, utilizing the winch and the elongate flexible member to lower the hydraulic pile driving hammer into engagement with each of the conductor casings in the array; and utilizing the hydraulic pile driving hammer deployed from the vessel to further embed the plurality of conductor casings in the array.

2. A method of installing conductor casings at a designated location on the seafloor comprising the steps of:

providing a plurality of conductor casings;

providing a vessel having a winch mounted thereon;

providing an elongate flexible member selected from the group consisting of cables, chains and ropes;

winding the elongate flexible member onto the winch;

providing a barge;

initially positioning the plurality of conductor casings on the barge;

connecting the distal end of the elongate flexible member to a top plate attached to a first of the plurality of conductor casings on the barge;

removing the first conductor casing from the barge and thereafter utilizing the winch and the elongate flexible member to lower the first conductor casing to the seafloor at a predetermined drilling location thereon;

utilizing the weight of the first conductor casing to initially embed the conductor casing into the seafloor;

providing a source of suction;

connecting the source of suction to the top plate on the first of the conductor casings following the initial embedding thereof in the seafloor and thereby further embedding the conductor casings into the seafloor;

removing the top plate and distal end of the elongate flexible member from the first conductor casing and attaching the distal end to a top plate attached to a second conductor casing;

removing the second conductor casing from the barge and thereafter utilizing the winch and the elongate flexible member to lower the second conductor casing to the seafloor at a predetermined drilling location thereon to from an array of conductor casings on the seafloor;

utilizing the weight of the second conductor casing to initially embed the conductor casing into the seafloor;

connecting the source of suction to the top plate on the second conductor casing following the initial embedding thereof in the seafloor and thereby further embedding the conductor casing into the seafloor;

removing the top plate and distal end of the elongate flexible member from the second conductor and placing the remainder of the plurality of conductors into predetermined drilling locations with the winch and elongate flexible members to form an array of conductor casings initially embedded into the seafloor under the weight of the casings and then further embedded into the seafloor under the application of suction to the conductor casings;

providing a hydraulic pile driving hammer;

initially positioning the hydraulic pile driving hammer on the vessel;

after the array of conductor casings has been formed, utilizing the winch and the elongate flexible member to lower the hydraulic pile driving hammer into engagement with each of the conductor casings in the array; and utilizing the hydraulic pile driving hammer deployed from the vessel to further embed the plurality of conductor casings in the array.

* * * * *